US009850658B2

(12) United States Patent
Alcala Ordaz

(10) Patent No.: US 9,850,658 B2
(45) Date of Patent: Dec. 26, 2017

(54) MODULAR, MULTIPERFORATED PERMANENT FORMWORK CONSTRUCTION SYSTEM FOR REINFORCED CONCRETE

(71) Applicant: ELEVEN SOLUTIONS RFE S.A. DE C.V., Querétaro (MX)

(72) Inventor: Ricardo Alcala Ordaz, Querétaro (MX)

(73) Assignee: ELEVEN SOLUTIONS RFE S.A. DE C.V., Queretaro (MX)

( * ) Notice: Subject to any disclaimer, the term of this patent is extended or adjusted under 35 U.S.C. 154(b) by 0 days.

(21) Appl. No.: 14/428,603

(22) PCT Filed: Sep. 17, 2012

(86) PCT No.: PCT/MX2012/000087
§ 371 (c)(1),
(2) Date: Mar. 16, 2015

(87) PCT Pub. No.: WO2014/042502
PCT Pub. Date: Mar. 20, 2014

(65) Prior Publication Data

US 2015/0275531 A1 Oct. 1, 2015

(51) Int. Cl.
*E04B 2/86* (2006.01)
*E04B 1/61* (2006.01)

(52) U.S. Cl.
CPC ..... *E04B 2/8635* (2013.01); *E04B 2/8658* (2013.01); *E04B 1/6137* (2013.01); *E04B 2/8641* (2013.01); *E04B 2002/867* (2013.01)

(58) Field of Classification Search
CPC ..... E04B 9/065; E04B 2/8658; E04B 2/867; E04B 2/8676; E04B 2/8641; E04B 2/8635; E04B 2/845
(Continued)

(56) References Cited

U.S. PATENT DOCUMENTS 1,848,357 A * 3/1932 Kotrbaty ..... E04B 2/845 52/241
1,877,898 A * 9/1932 Kotrbaty ..... E04B 2/845 52/255

(Continued)

FOREIGN PATENT DOCUMENTS

CA 2070079 6/1997
FR 2746126 A1 9/1997

(Continued)

OTHER PUBLICATIONS

Written Opinion of the International Searching Authority for PCT/MX/2012/000087 dated May 28, 2013. Spanish with English Translation. 10 pages.

(Continued)

*Primary Examiner* — Michael Safavi
(74) *Attorney, Agent, or Firm* — Smith, Gambrell & Russell, LLP

(57) ABSTRACT

The present invention relates to a modular construction system with molding formwork or permanent formwork for concrete or reinforced concrete industry aimed at building construction. It Incorporates a number of key elements: structural-elements for forming flat walls, corner-elements, -elements connectors between the flat elements, auxiliary-elements of rectangular cross section which are located adjacent to the panels. Each cell has at least one of their edges a longitudinal rail and at the opposite end has at least one counter-rail so that they can connect adjacent elements. Along the inner surface of the flat structural elements exists at least one longitudinal rail in order to couple connectors between each pair of elements and stabilize the position. Once the final structure concrete is poured into the hollow interior of this cavity and flows through the perforations in the structure generating a textured finish that can also
(Continued)

receive other materials for creating different types of coating.

24 Claims, 26 Drawing Sheets

(58) Field of Classification Search
USPC ..... 428/596, 599, 603; 52/426, 439
See application file for complete search history.

(56) References Cited

U.S. PATENT DOCUMENTS 1,960,961 A * 5/1934 Thomas ..... E04B 2/78 52/241
2,101,073 A * 12/1937 Kotrbaty ..... E04B 2/845 52/281
3,279,137 A * 10/1966 Pavlecka ..... B62D 33/04 52/213
4,299,070 A * 11/1981 Oltmanns ..... E04B 2/72 52/309.11
4,438,614 A * 3/1984 Raith ..... E04B 2/7401 52/481.2
4,557,091 A * 12/1985 Auer ..... E04B 2/72 52/282.2
5,311,718 A * 5/1994 Trousilek ..... E04B 2/8629 52/421
5,465,545 A 11/1995 Trousilek
5,473,850 A * 12/1995 Balding ..... E04B 2/8629 52/426
5,528,876 A * 6/1996 Lu ..... E04B 2/8658 52/425
5,553,430 A * 9/1996 Majnaric ..... E01D 11/00 52/236.8
5,608,999 A * 3/1997 McNamara ..... E04B 1/12 52/220.1
5,706,620 A * 1/1998 De Zen ..... E04B 1/12 52/220.2
5,729,944 A * 3/1998 De Zen ..... E04B 1/12 264/154
5,735,090 A * 4/1998 Papke ..... E02D 27/00 52/220.2
5,740,648 A * 4/1998 Piccone ..... E04B 2/86 249/191
5,860,262 A * 1/1999 Johnson ..... E04B 1/14 52/293.1
5,953,880 A * 9/1999 De Zen ..... E04B 1/12 405/257
5,974,751 A * 11/1999 De Zen ..... E04B 2/8629 264/154
6,167,669 B1 * 1/2001 Lanc ..... E04B 2/8641 52/426
6,189,269 B1 * 2/2001 De Zen ..... E04B 1/14 52/220.1
6,212,845 B1 * 4/2001 De Zen ..... E04B 1/12 52/144
6,247,280 B1 * 6/2001 Grinshpun ..... E04B 2/8635 52/309.12
6,295,770 B1 * 10/2001 Sheu ..... E04B 1/161 52/167.1
6,435,471 B1 * 8/2002 Piccone ..... E04B 2/8641 249/191
6,591,558 B1 * 7/2003 De Zen ..... E04B 1/12 52/91.1
6,725,601 B2 4/2004 Chick
7,628,570 B2 12/2009 Davidsaver
7,703,248 B2 * 4/2010 Dincel ..... E04B 2/8629 264/209.1
7,797,897 B2 * 9/2010 Roth ..... E04B 1/12 52/270
7,818,919 B1 10/2010 Maxwell-Merrill et al.
8,240,104 B2 * 8/2012 Koikas ..... E04B 2/8629 52/479
8,322,115 B2 * 12/2012 Foell ..... E04B 2/8629 52/309.17
8,677,713 B1 * 3/2014 Sheehy ..... E04C 2/20 52/284
8,973,313 B2 * 3/2015 Bettiol ..... E04B 1/12 137/357
2004/0010994 A1 * 1/2004 Piccone ..... E04B 2/8658 52/425
2008/0022619 A1 1/2008 Scherrer
2010/0251657 A1 * 10/2010 Richardson ..... E04B 2/8641 52/588.1
2013/0140427 A1 * 6/2013 Martigli ..... E04B 2/8629 249/13
2014/0318062 A1 * 10/2014 Richardson ..... E04B 2/8635 52/309.1
2014/0318067 A1 * 10/2014 Richardson ..... E04B 2/8652 52/428
2015/0275531 A1 10/2015 Alcala Ordaz
2015/0300011 A1 10/2015 Lopez Otamendi et al.

FOREIGN PATENT DOCUMENTS

JP 2008029322 A 2/2008
JP 2012075397 A 4/2012
WO 2005/098158 10/2005
WO 2010142000 A1 12/2010
WO 2012010792 A1 1/2012
WO WO 2012/017462 * 2/2012 ..... E04B 2/8623
ZA WO 0028166 A1 * 5/2000 ..... E04B 2/8658

OTHER PUBLICATIONS

International Search Report for PCT/MX/2012/000087 dated Mar. 28, 2013. Spanish with English Translation, 6 pages.

* cited by examiner

MODULAR, MULTIPERFORATED PERMANENT FORMWORK CONSTRUCTION SYSTEM FOR REINFORCED CONCRETE

FIELD OF THE INVENTION

The present invention relates to a modular construction molding system with multi-perforated arch centering for concrete or reinforced concrete of direct application to the construction industry, for the construction of all types of real estate properties. More specifically the modular construction system of permanent formwork molding refers to a set of elements including: first polymeric flat structural components, second, corner components; third flat connecting components, fourth: panel-shaped components; each component of the modular system includes longitudinally at the end at least one rail, and at the opposite end of the edge at least one counter rail, the flat components across the width of its longitudinal surface have at least one longitudinal rail for coupling flat connectors, for assembly of the rail system and counter rails of the structural components, which are coupled and locked together slidably to each other, successively until forming a mold structure with permanent arch centering with hollow interconnected interior cavities and multiperforated exposed faces in the hollow cavities where concrete is spread, on the exposed multiperforated faces concrete sprouts and is impregnated, thus covering the permanent arch centering and generating a new texture to the surface. This new surface can receive any type of finish.

BACKGROUND OF THE INVENTION

Currently in the construction industry there are a variety of materials and processes for construction of buildings. The most developed areas are prefabricated modular systems and materials, as these are useful anywhere where you need to build, whether it is for a small or a large building. These materials and systems offer numerous solutions for businesses and individuals, because the construction can be completed in very short periods of time, with greater control over the work, with cleaner, safe and durable works, furthermore these materials are easy to assemble and the labor used is not specialized or regional.

Currently there have been developed various components and modular systems for these purposes, for example there are some panel systems made of rigid PVC as well as foamed PVC panel systems, systems with flat components, systems with angular components, extruded PVC systems, with elements to be continuously assembled together. These systems are complemented by structural reinforcement elements such as metal columns and rods for the construction of all types of outer walls, inner wall partitions, contemplating the formation of walls in corners with all these elements for different types of buildings.

For example, the description of U.S. Pat. No. 5,608,999 (MX 202025), describes the use of a series of flat thermoplastic structural components and thermoplastic corner structural components, where some components are locked slidably and releasably together to form continuous wall structure with hollow cells, where these cells receive poured internal concrete and the surface finish is always smooth and plastic. The structural system components of the system of Bernard McNamara as has been disclosed include flat connectors, flat caps and corner angles, prefabricated and extruded in rigid PVC, so they can be assembled on-site, with unskilled labor and short periods of time.

A disadvantage of thermoplastic structural system components of the Bernard McNamara system, is that in order to assemble a wall structure a lot of individual elements for assembly of the system are required, consequently any such manipulation of a lot of elements significantly increases the time of assembly and construction, in addition the final surface finish will always be smooth and plastic.

The description of U.S. Pat. No. 5,729,944 discloses a building constructed of extruded thermoplastic structural components, these components include hollow panels, hollow connectors, hollow beams and adapters. For the assembly of the system the extruded components are locked over the edge together continuously to form vertical walls and the roof of the building. Each wall to structural component is hollow, is made from PVC plastic material, and formed of spaced inner and outer walls connected by transverse entanglements that form internal cells, this essentially appears as a mold into which concrete is poured to form outer and inner wall faces with smooth finish and plastic.

A disadvantage of the system of Vittorio De Zen is that the thermoplastic hollow panel is formed at both ends of the edge for engaging and interlocking with a male member, for assembly between panels to build a continuous flat wall, a connector is always required between panels, without these connectors it is not possible to assemble the panels, in addition the resulting final surface will be smooth and plastic.

The Mexican Patent Application PCT/MX2005/000012 with International Publication Number WO 2005/098158 A1 discloses and describes a panel structure with coupling means, for prefabricated buildings, the panel structure of rectangular longitudinal shape with internal individual cavities that are not interconnected, with ease of assembly and engagement with each other, wherein complementary structural elements such as steel columns are inserted and engage only in the cavities formed between the panel structure assemblies against the panel structure, such that concrete or some other material is poured into the internal cavities, forming a wall structure with plastic surface finish for the construction of buildings.

A major disadvantage of this panel structure system with coupling means, for prefabricated buildings, is that there is no internal communication between the elements and their internal cavities in the structure of vertical wall, thus reducing the structural capabilities of the system and when the concrete is poured a final continuous monolithic structure is not obtained, to achieve structural stability the system uses steel columns of noncommercial structural shapes, so this greatly increases manufacturing costs and project costs, and furthermore the surface finish will always be smooth and plastic.

U.S. Pat. No. 7,628,570 B2 US discloses a modular retaining wall where the wall is at least partially below the surface, where the surface may be land-based or water-based; the walls are composed of polygonal modules with open and closed channels disposed therein, in addition to components such as hollow profiles, flat profiles, module connectors, hollow corner connector profiles and hollow adapters. The wall modules are fastened together by respective coupling and fastening closures so that connectivity is provided between the modules, however the ability for the liquid to pass through is retained, always having a smooth and plastic surface finish.

A disadvantage of the modular system of John Davidsaver and Acott Yeany is that in forming intermediate configurations for walls and dividers, nuts and bolts are required, and this increases the time of building and the apparently low costs for these items, but are in fact at a large scale reflected in longer periods of construction and project costs; furthermore, the final surface finish is always smooth and plastic.

Due to the above, there is in the market a need for a modular construction system that is more versatile, handy and of a smaller scale, easy to assemble and enabling rapid construction for use in the construction industry, for the building of any kind of construction, which solves the disadvantages mentioned that is more functional over existing systems. The present invention aims to provide a solution to this gap detected, and would be of great relevance in the area of prefabricated construction materials in the construction industry.

OBJECTIVES

The present invention is generally intended to provide a modular construction system of multi-perforated permanent formwork for reinforced concrete, which is assembled and coupled structurally with panels and components that are easily and quickly constructed.

Another objective of the present invention is to provide a permanent construction system with permanent arch centering, multi-perforated for reinforced concrete, with hollow cavities interconnected to function as a mold of permanent arch centering formwork such that the concrete poured into the cavities by the multiperforated surfaces with anterior and posterior concrete "sprout" hiding permanently the formwork and generating a new texture on the surface, which can receive any additional finish.

Another object of the invention is to provide a modular building system of permanent formwork for reinforced multi-perforated concrete, where a final specific surface is exposed and can receive any type of finish.

Another object of the invention is to provide a modular construction system multi-perforated permanent formwork for reinforced concrete, where one of the exposed end surfaces of the concrete wall is able to receive any type of finish and the remaining wall surface has smooth and plastic finish.

Another objective of the invention is to provide a modular molding system of permanent multiperforated formwork for reinforced concrete where panels and hollow components are molds for pouring concrete, which support the weight and the expansion of the concrete.

Another important objective is to make available a panel and modular structural multi-perforated components with coupling means easily and stably assembled together, eliminating the use of nuts, bolts, welding, bolts, wedges, and stay bolts.

Another object of the invention is to provide a modular panel system with prefabricated structural multi-perforated components for an assisted self construction model where manual labor can be regional and unskilled.

Another object of the invention is to make available a modular construction system of permanent formwork multiperforated for reinforced concrete that is resistant, of low molecular weight, thermo acoustic, thereby minimizing energy consumption and build time.

Another object of the invention is to make available a modular construction system of permanent formwork multiperforated for reinforced concrete where doors, windows, electrical, hydraulic, sanitary facilities are compatible with the system.

A further object of the present invention is to provide a modular multi-perforated system with prefabricated polymeric components, that can be implemented in all kinds of constructions while maintaining the characteristics of being lightweight, easy to manipulate, easy to transport, and easy to assemble.

A further object of the present invention to provide a modular construction system of permanent formwork for reinforced concrete where modules can be trimmed and sectioned according to the requirements and needs of the construction project.

Another object of the invention is to provide a modular construction system of permanent multiperforated formwork for reinforced concrete that when assembled acts as an integrated structure yet can be reinforced as needed.

Finally another object of the invention is to make available a modular construction system of multi-perforated permanent formwork for reinforced concrete where prefabricated components are extruded from high strength polymeric materials enabling large-scale production.

SUMMARY OF THE INVENTION

The elements of the modular construction system of permanent formwork multi-perforated for reinforced concrete in all its forms and its plurality of arrays are formed first by modular flat multi-perforated profiles characterized by including a multi-perforated longitudinal surface, featuring at the ends of the edge perpendicular to the longitudinal multi-perforated surface a longitudinal extension having a rail all along the edge of a geometrical form that defined a female element, the remaining end on the longitudinal rail having a male element, as coupling means, interlocking, the width of the multi-perforated longitudinal surface including a plurality of longitudinal rails of T-shape for connecting the flat couplings.

Second: a modular multi-perforated hollow corner connector characterized by including two perpendicular longitudinal elongated faces joined together with cut cores distributed longitudinally, these attached to a multi-perforated semicircular longitudinal surface, said multi-perforated modular connector having on one of the perpendicular longitudinal faces integrated thereon two rails of defined geometric shape as a female element and on the remaining face integrated thereon two rails geometrically defined as a male element, such elements provided as engagement and interlocking means.

Third: a flat modular connector characterized by comprising a longitudinal surface with sections of cut cores strategically distributed longitudinally, in addition to including at both ends of the edge a U-shaped longitudinal rail with extended inward edges as coupling means. Also a flat modular multi-perforated connector with rectangular profile is characterized by including a multi-perforated front wall, a rear multi-perforated wall and longitudinal ribs with sections of cut cores longitudinally and strategically distributed perpendicular to the multiperforated walls, said modular connectors in a rib having two rails integrated defined geometrically as a female element, on the remaining rib there are two rails integrated, geometrically defined as a male element, as engagement, coupling, and interlocking means.

Fourth: One multi-perforated modular panel characterized by comprising a rectangular configuration, a longitudinal multi-perforated front wall, a longitudinal multi-perforated rear wall, a plurality of longitudinal ribs with core cut sections strategically distributed longitudinally, forming between these, interconnected rectangular cavities, at one end of the multi-perforated modular panel on the rib there being integrated two longitudinal rails defined geometrically as the female element, on the remaining rib there being integrated two longitudinal rails defined geometrically as the male element, as engagement interlocking, and crimping means.

The assembly of modular construction system of permanent formwork multi-perforated for reinforced concrete consists of the continuous and subsequent coupling of the components of the modular construction system, where each component includes in at least one of its ends a male element and at the remaining end a female element; for the coupling between the elements, the rail with the male element is engaged, is fitted and slides against the rail with the female element performing continuous and subsequent assembly of the components of the building system to form a structural configuration with permanent formwork molds multi-perforated with all interior hollow cavities communicated with each other and whose front and back walls of the permanent formwork mold are multiperforated.

In the reception cavities of the mold structure of permanent formwork can be poured concrete or other aggregate, through multiperforated surface the poured concrete will have the effect of "sprouting and impregnating the multiperforated surfaces" thus generating a new texture to the surface covering and hiding to the structure of permanent formwork mold. The permanent formwork covered by the concrete cover on its front and back faces are able to have any additional finishing either smooth, textured, etched or adding another material.

Walls obtained by the modular construction system of permanent formwork forming the building can be blind, comprise windows, doors, openings for air conditioning; since the plurality of arrangements between panels and thermoplastic elements forms interconnected internal cavities, these allow you to place sight unseen, electrical, voice, data wiring, water, sanitary facilities, furthermore, you can structurally reinforce the system by installing rods in the cavities or a commercial structural shape vertically or horizontally according to the needs of the construction project.

The modular construction system of permanent formwork multiperforated for reinforced concrete is designed for construction and buildings of all kinds, where all components of the modular construction system can be manufactured, cut and sectioned according to the needs of the construction project.

The modular construction system of multiperforated permanent formwork for reinforced concrete as configured and described provides structural properties because of being formed as a structural element in itself, includes a solid and reinforced structure, thereby increasing its load capacities, mechanical strength, yet being also easy to manufacture, easy to transport and maneuver, easy to install and useable on any type of construction.

DETAILED DESCRIPTION OF PREFERRED EMBODIMENTS

Figure 1A:
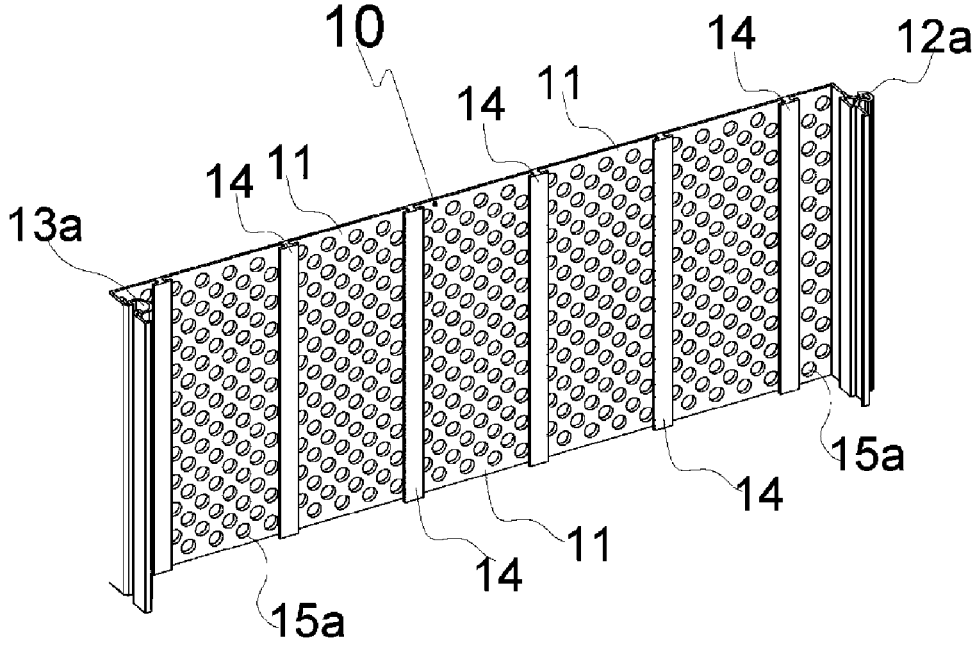
FIGS. 1A to 1H schematically show various views of the modular flat multi-perforated profile with details illustrating the different types and arrangements of multi-perforations and partially enlarged details showing the female and male coupling means.
Figure 1B:
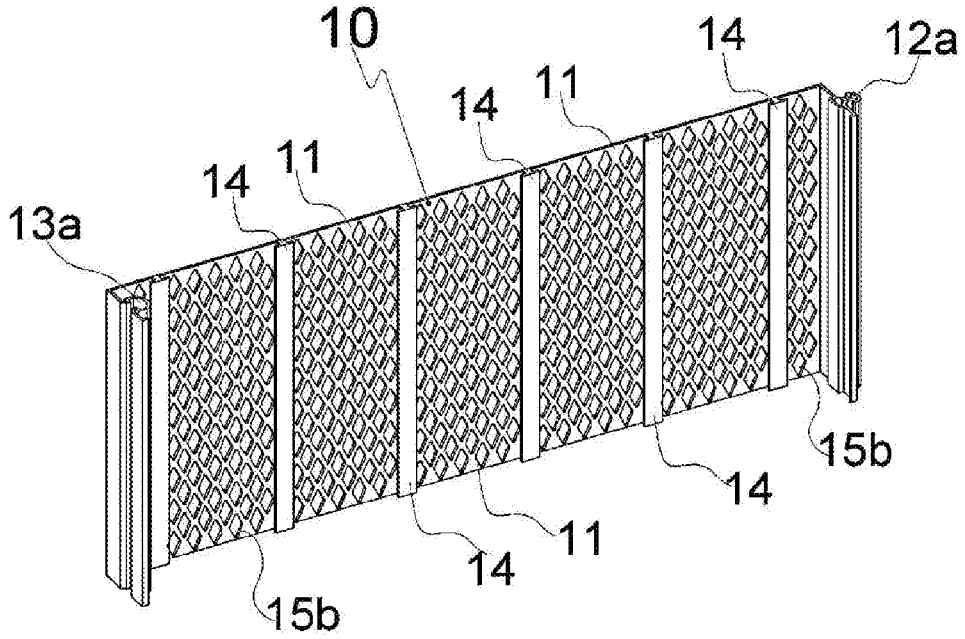
Figure 1C:
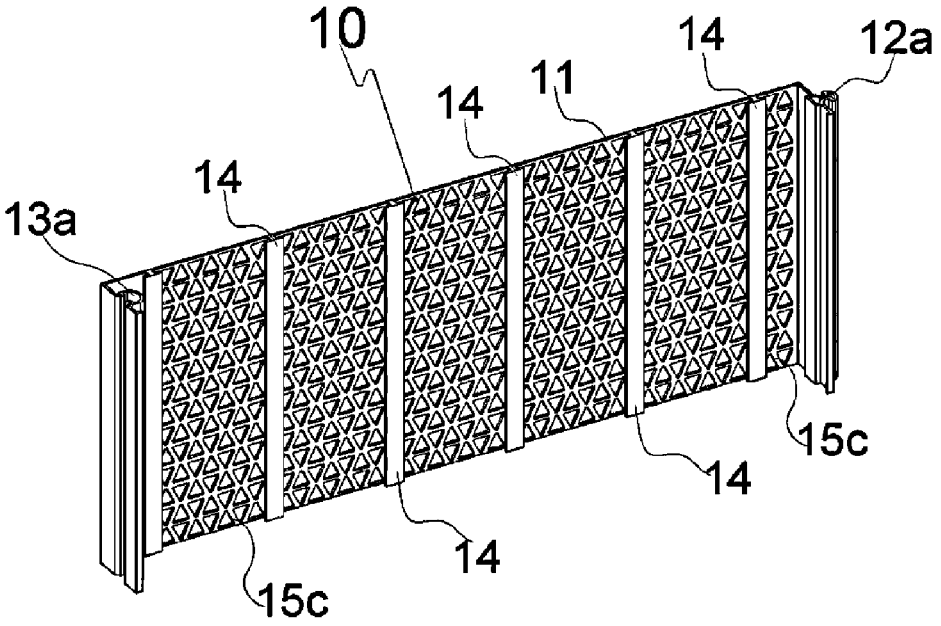
Figure 1D:
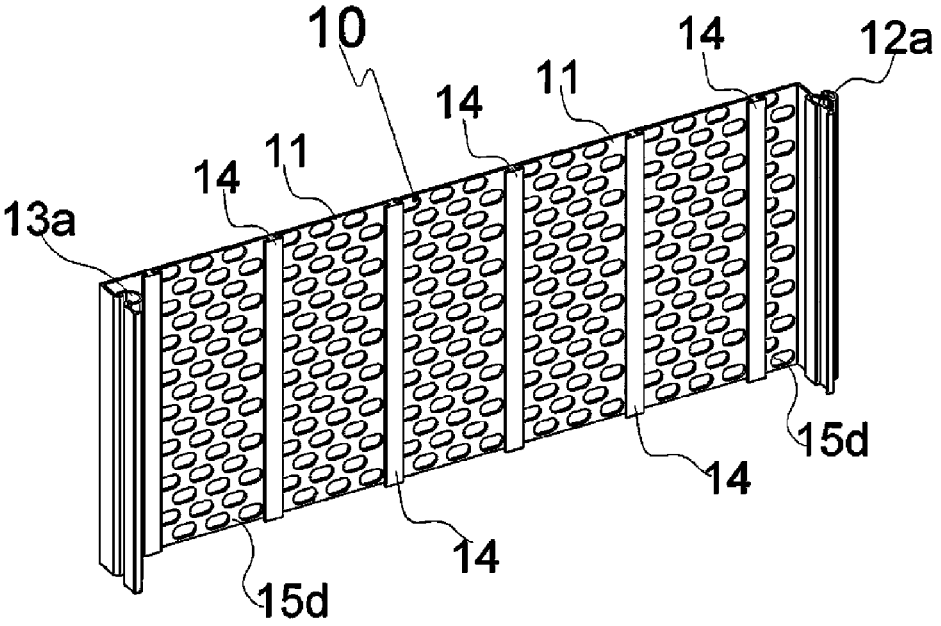
Figure 1E:
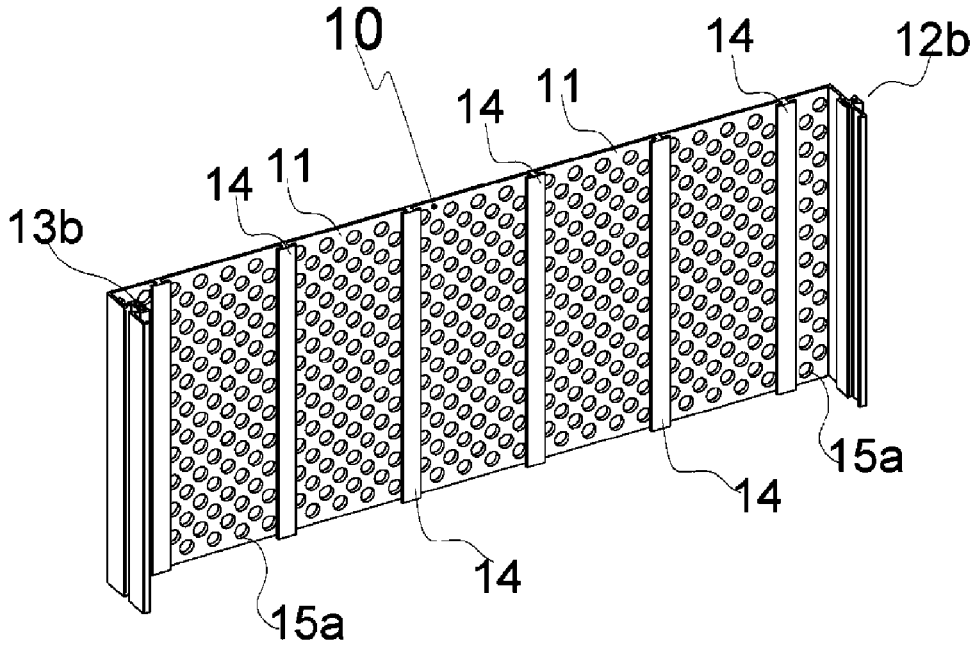
Figure 1F:
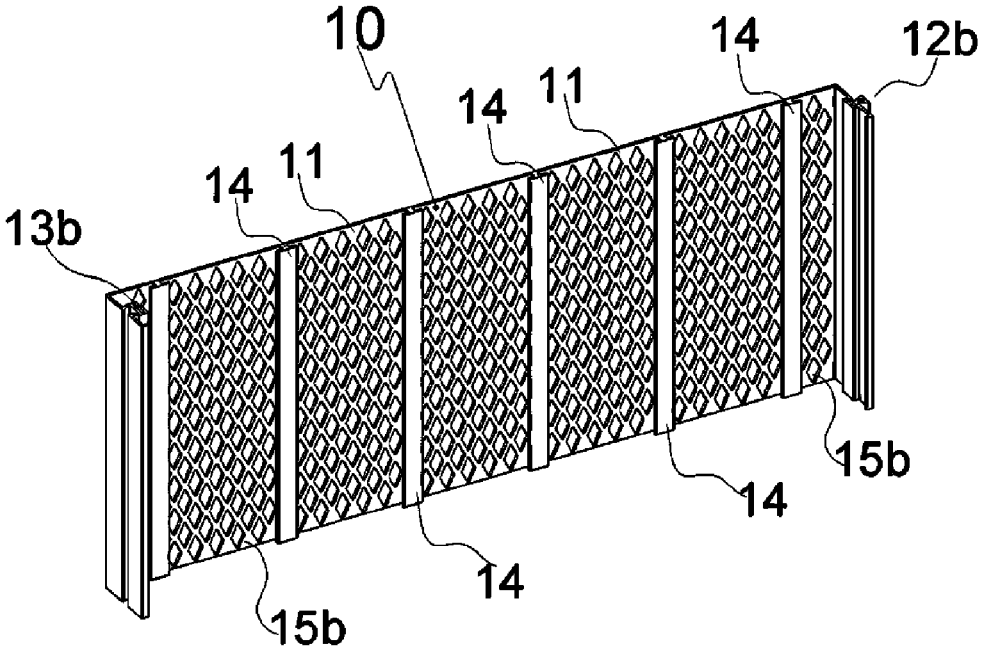
Figure 1G:
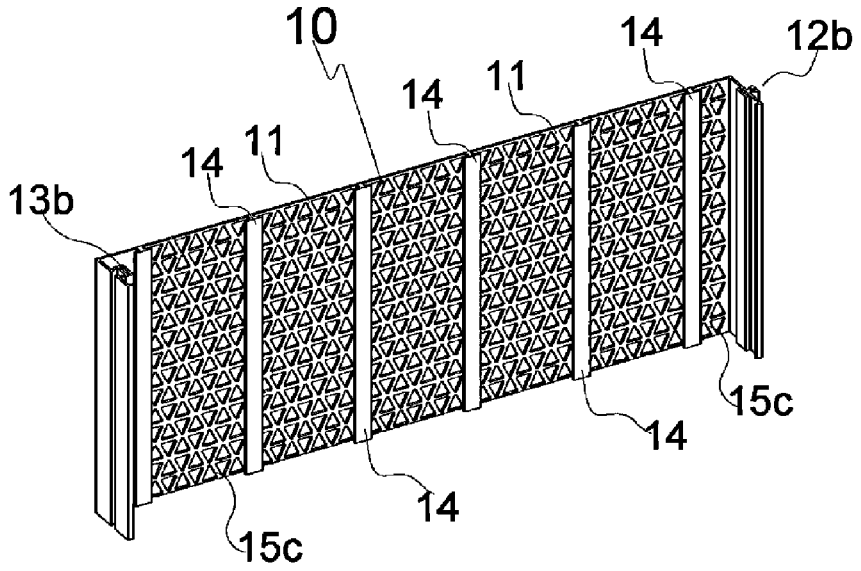
Figure 1H:
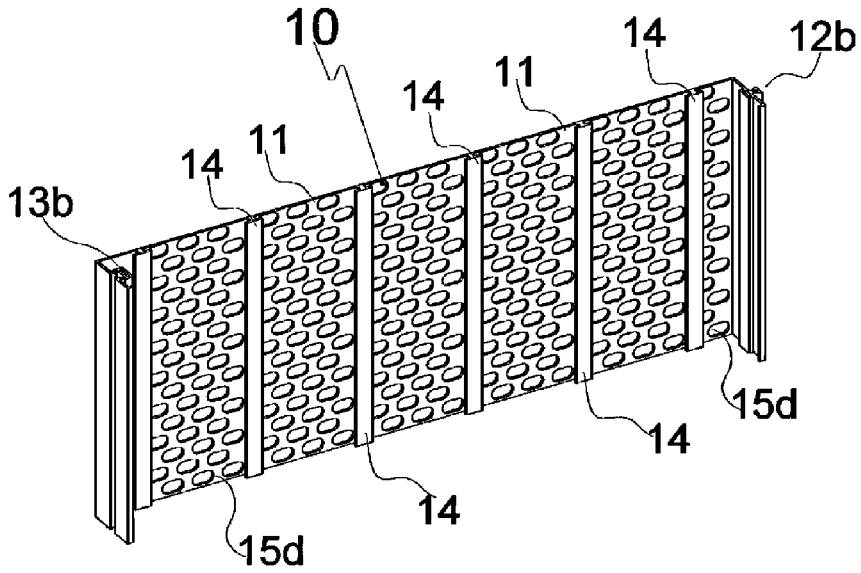
Figure 2A:
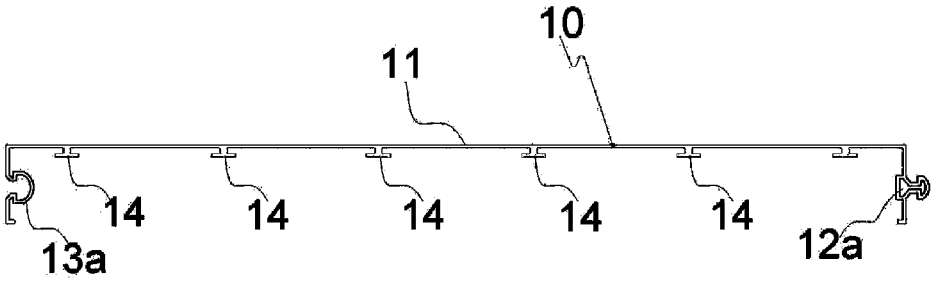
FIGS. 2A to 2B show top and bottom plan views of the multi-perforated modular profile of FIG. 1A, with partially enlarged details of the coupling means of female and male type.
Figure 2B:
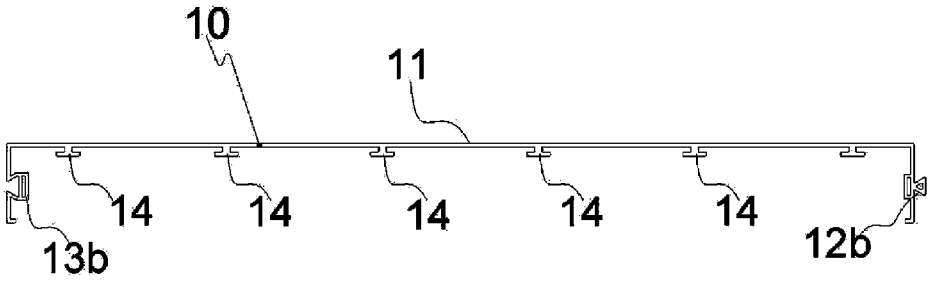
Figure 3A:
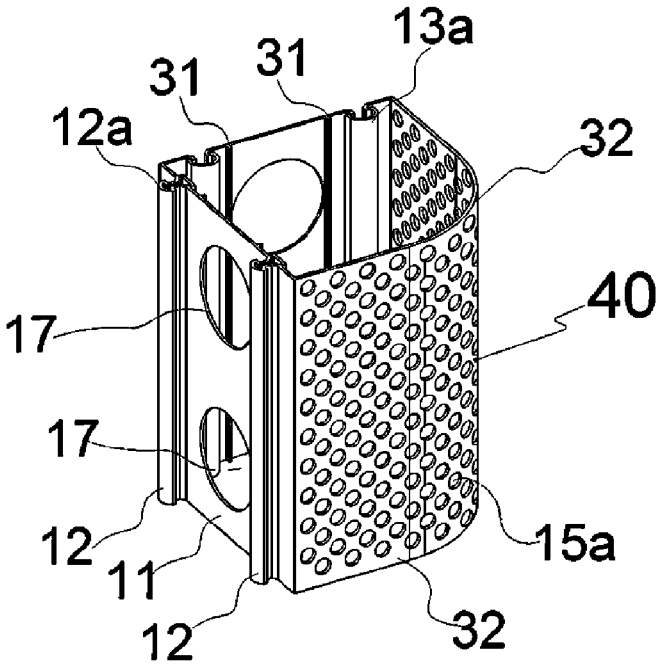
FIGS. 3A to 3H show perspective views of multi-perforated modular corner connector profiles with details illustrating the different types and arrangements of multi-perforations, and details showing the male and female coupling types.
Figure 3B:
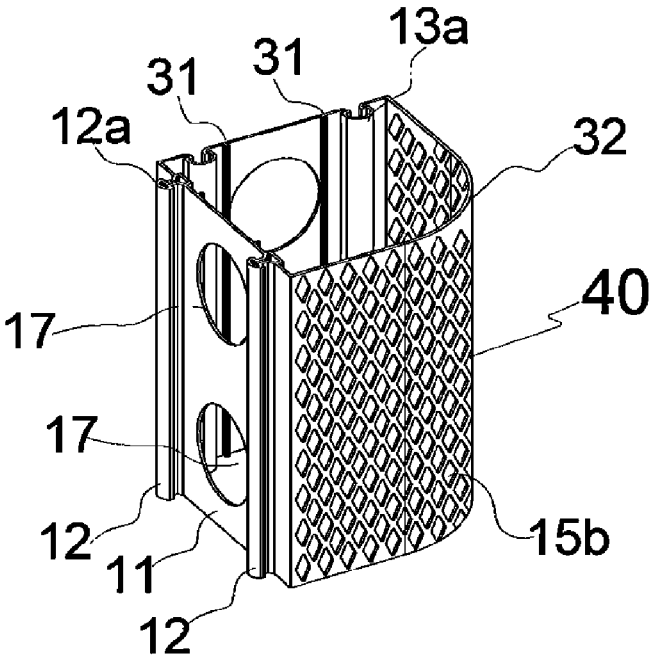
Figure 3C:
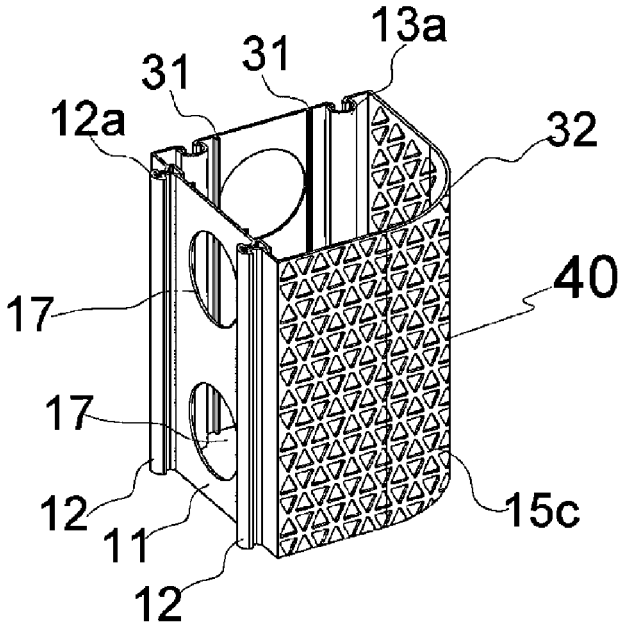
Figure 3D:
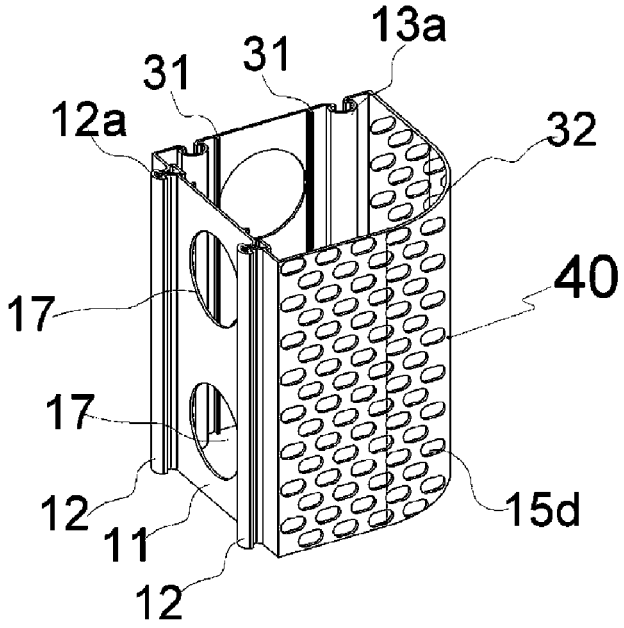
Figure 3E:
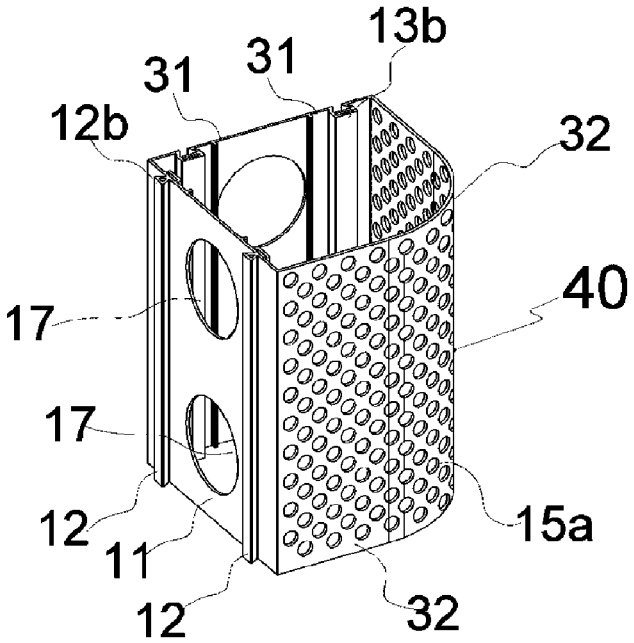
Figure 3F:
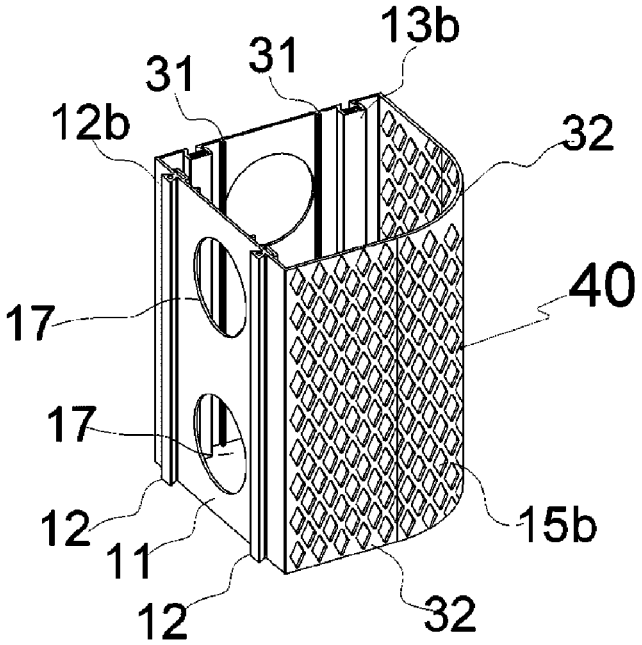
Figure 3G:
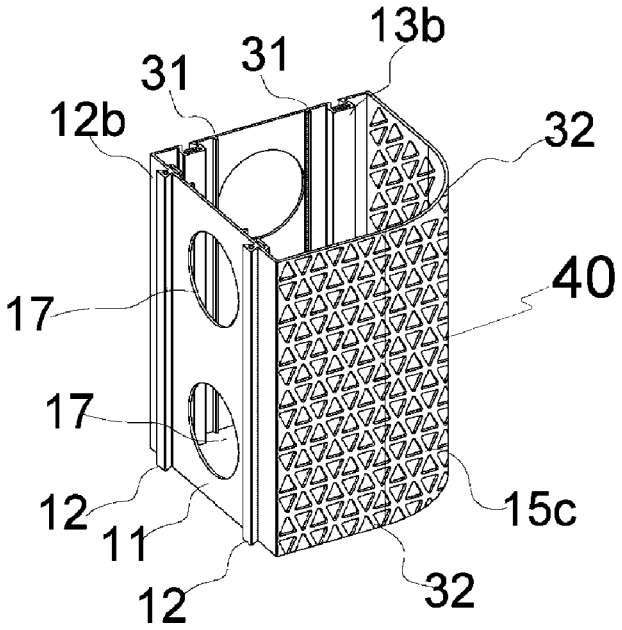
Figure 3H:
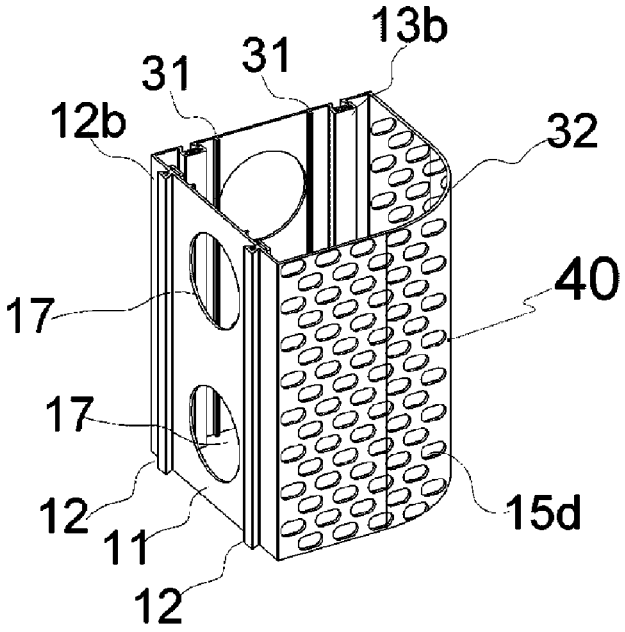
Figure 4A:
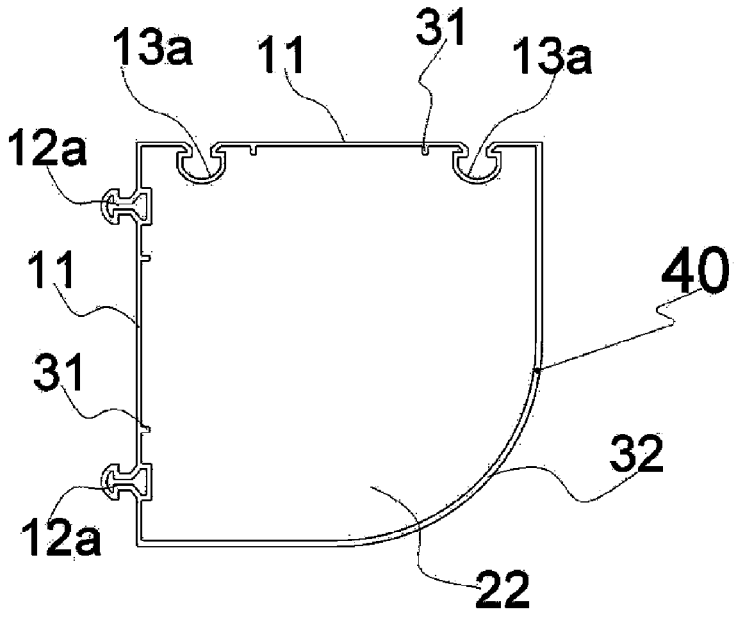
FIG. 4A to 4B shows different views of the multi-perforated modular corner connector profile of FIG. 3A with details showing the female and male coupling means.
Figure 4B:
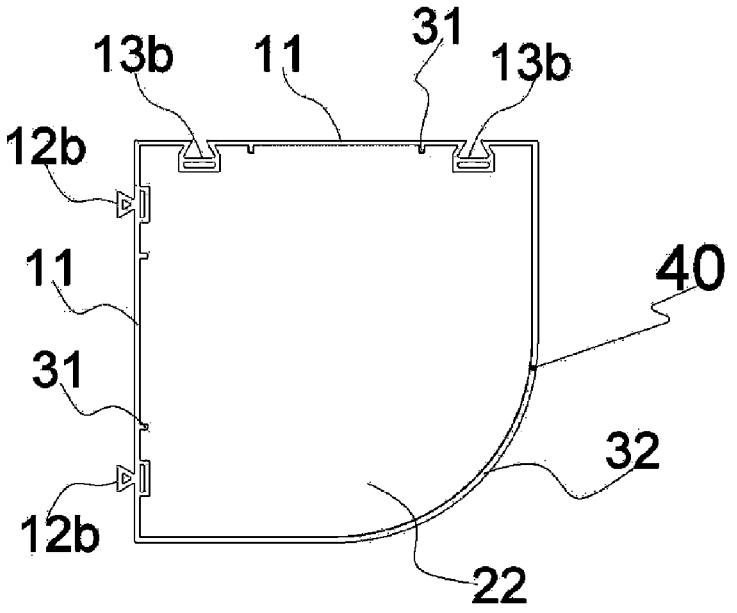

The characteristic details of the modular construction system of permanent formwork perforated for reinforced concrete are shown in the following illustrative description and accompanying drawings, wherein the same reference symbols are used to indicate the same parts.

As shown in Figures sets 1 and 2, a multiperforated flat modular profile 10 includes an elongated longitudinal surface 11, multiperforations 15 that can be of different types 15*a*, 15*b*, 15*c*, 15*d* strategically distributed on the surface 11, at an end perpendicular to the surface 11 is provided a longitudinal extension, all along the end is a rail geometrically defined as a female element 13 that may be of the type 13*a* or 13*b*, the remaining end in the longitudinal rail a having a male element 12 may be of type 12*a* or 12*b*, such rails acting as engaging, coupling, and interlocking means, the width of the multi-longitudinal surface 11 comprises a plurality of longitudinal T-shaped rails 14 to engage the flat connectors.

With reference to Figure sets 3 and 4 there is show a multiperforated modular connector with a corner profile 40 with hollow cavity 22 characterized by including two perpendicular interconnected longitudinal elongated faces 23 with sections of cores cut 17 longitudinally distributed, in addition to including two parallel longitudinal lips 31 crossing to the surface 23, an elongated longitudinal semicircular profile 32 with multiperforations 15 and who's multiperforations can be of different types of 15*a*, 15*b*, 15*c*, 15*d*, said multiperforated modular connector 40 in one of the perpendicular longitudinal sides 23 has integrated thereon on one side two rails geometrically defined as a female element 13 which may be of the type 13*a* or 13*b*, and on the remaining side 23 having two rails integrated geometrically defined as male element 12 which may be of the type 12*a* or 12*b*, as a means of engaging, coupling, and, interlocking.

Figure 5:
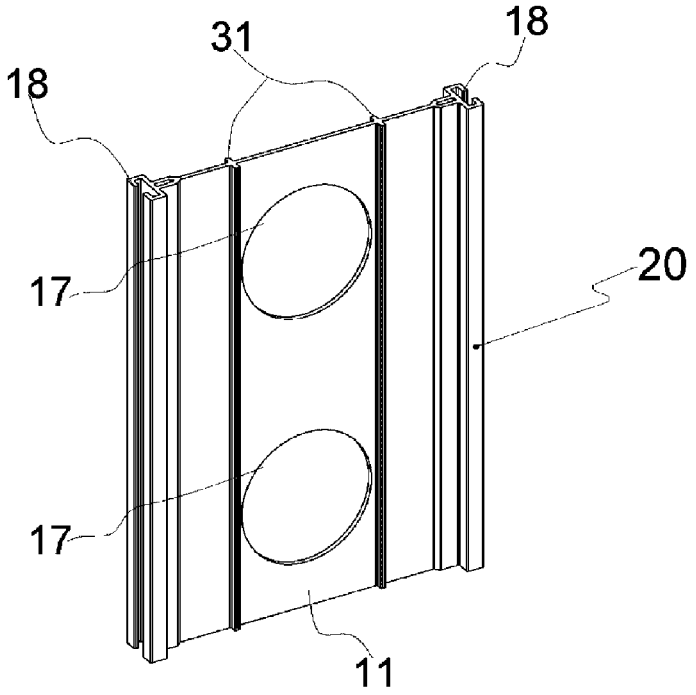
FIG. 5 schematically shows a perspective view of a flat profile modular connector of the construction system.
Figure 6:
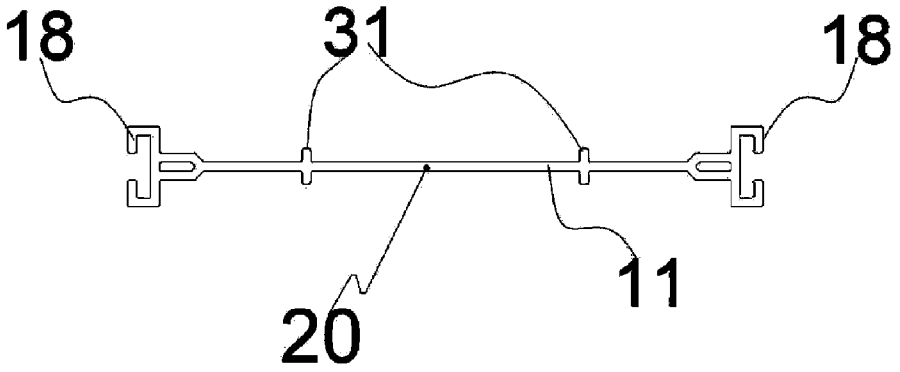
FIG. 6 schematically shows the top view of the modular flat profile of FIG. 5.
Figure 7A:
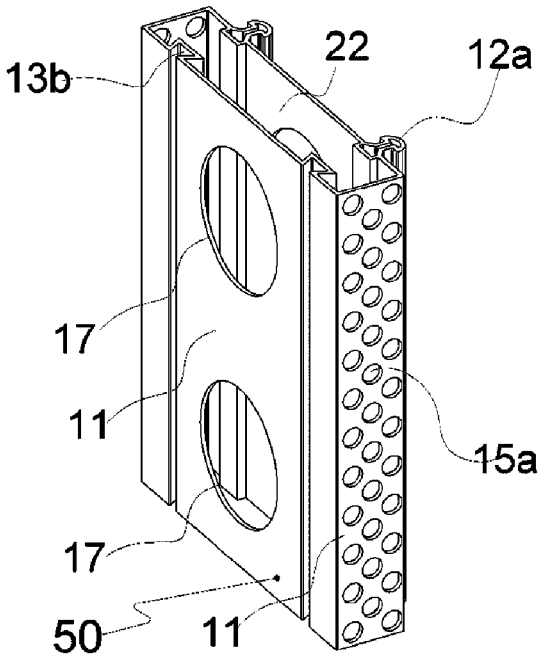
FIG. 7A to 7H show the perspective views of the multi-perforated modular flat profile connector with details showing different types and arrangements of multi-perforations and details of the coupling means of female and male type.
Figure 7B:
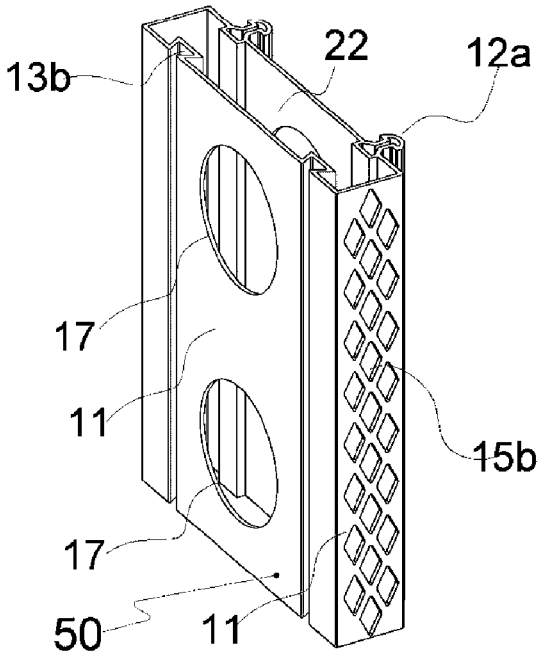
Figure 7C:
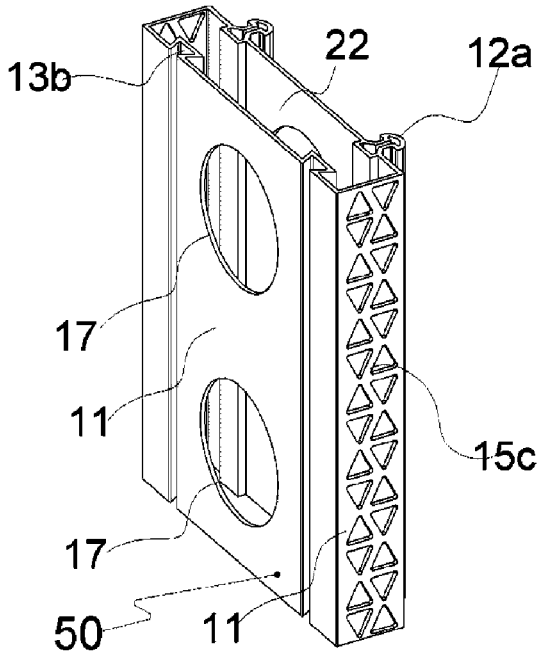
Figure 7D:
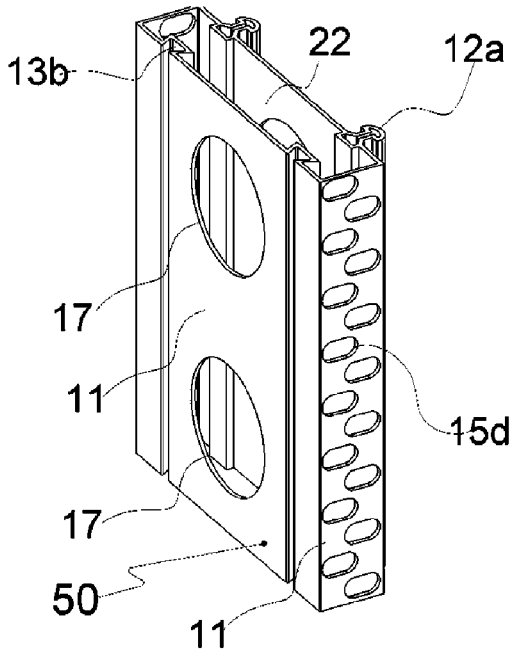
Figure 7E:
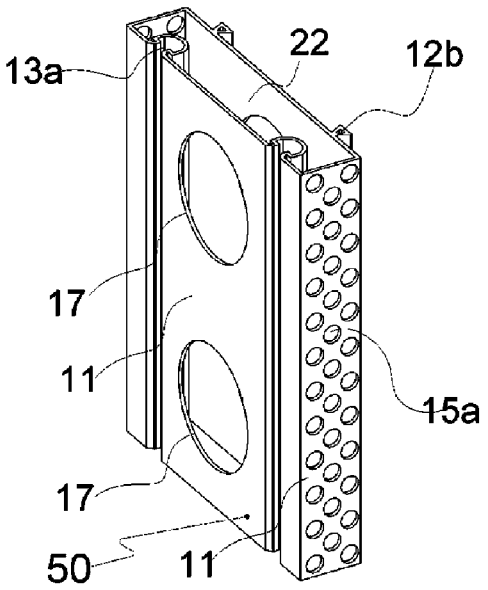
Figure 7F:
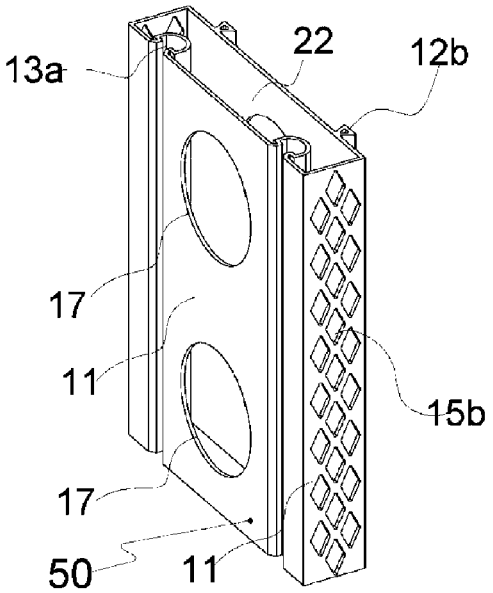
Figure 7G:
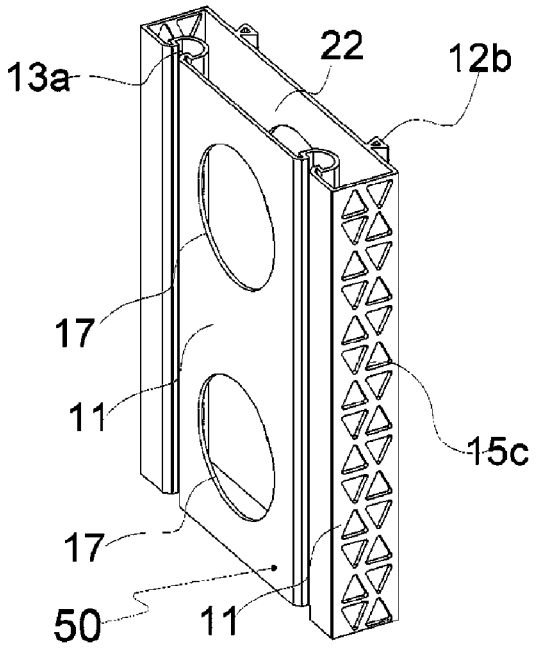
Figure 7H:
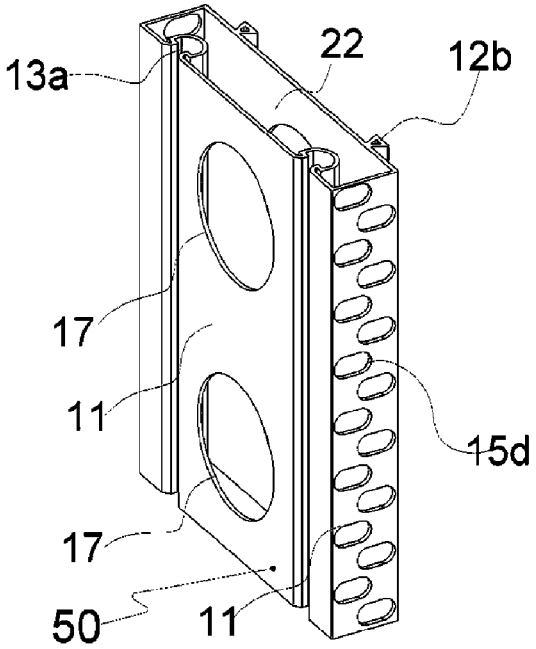
Figure 8A:
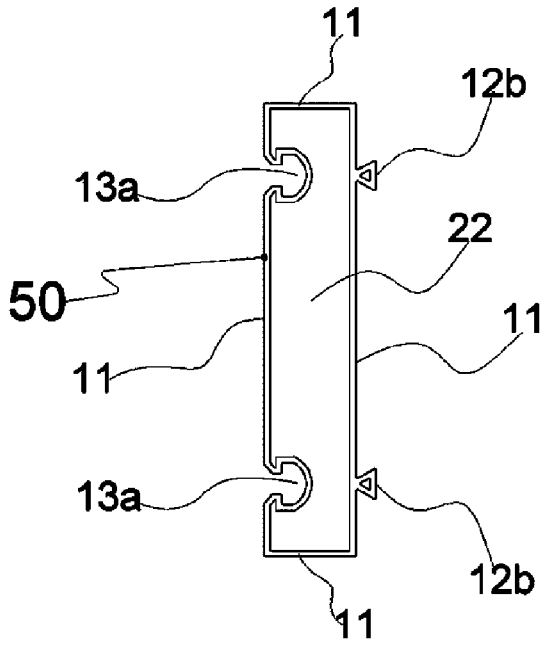
FIGS. 8A and 8B shows a top view of the multi-perforated modular flat profile connector of FIG. 7A with details of different female and male coupling means.
Figure 8B:
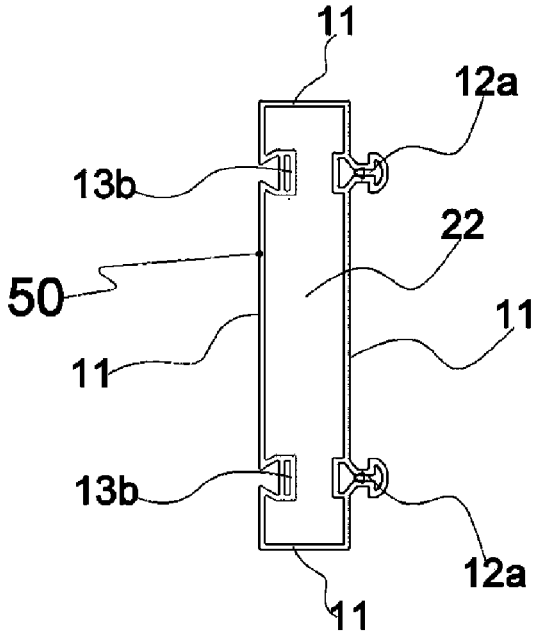
Figure 9A:
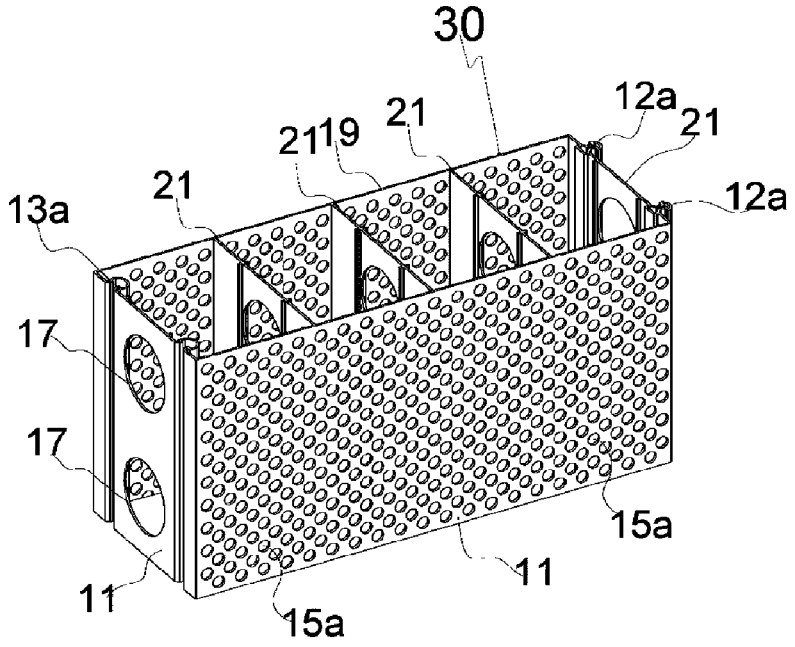
FIGS. 9A to 9H show perspective views of the multi-perforated modular panel with partially enlarged details of the type and arrangement of multi-perforations at the anterior and posterior surface, and details showing the female and male coupling means.
Figure 9B:
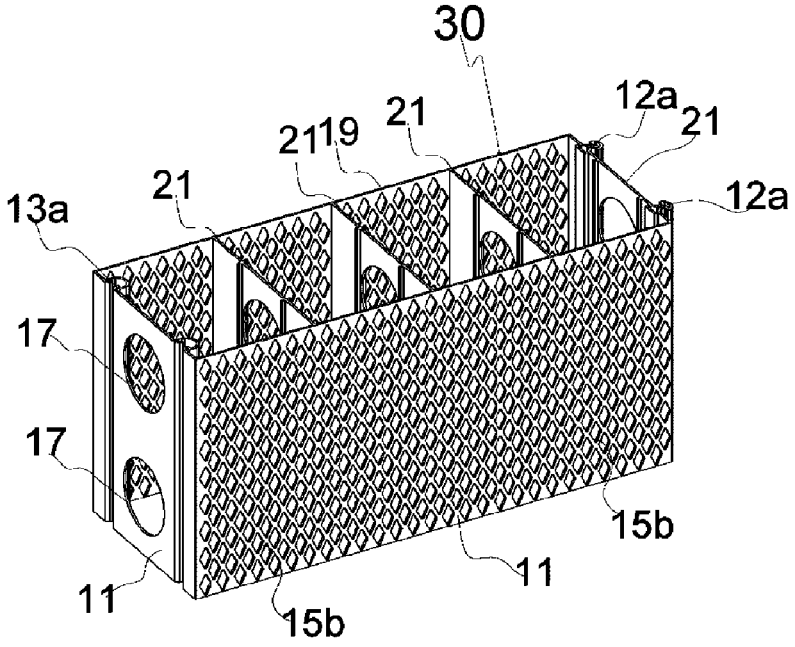
Figure 9C:
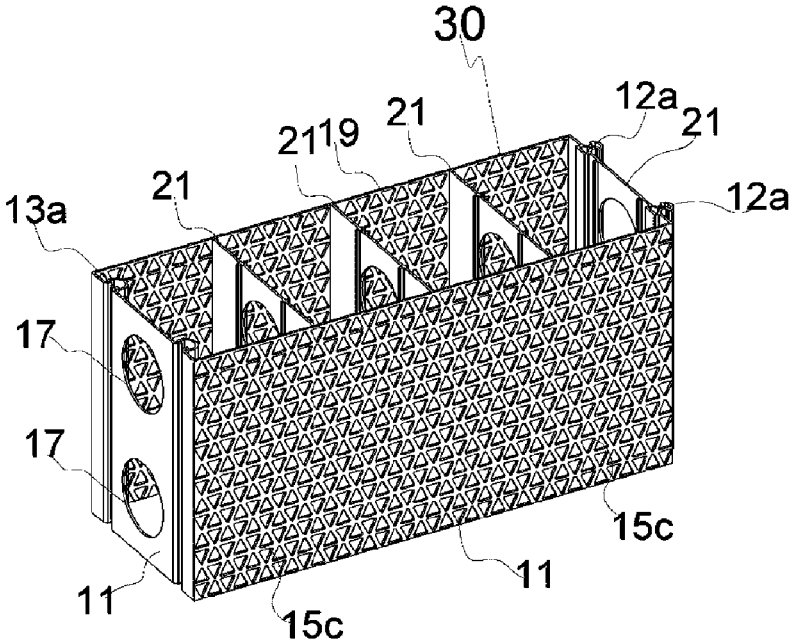
Figure 9D:
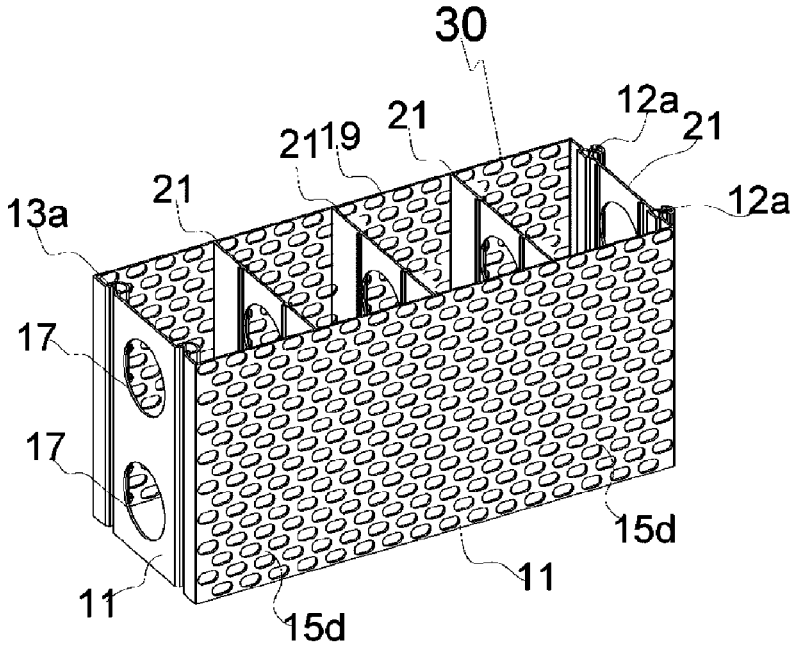
Figure 9E:
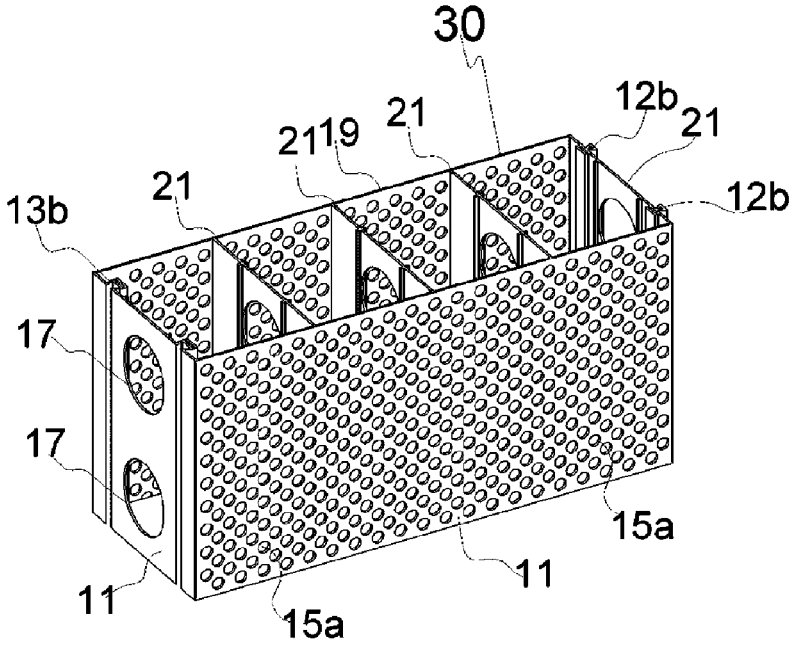
Figure 9F:
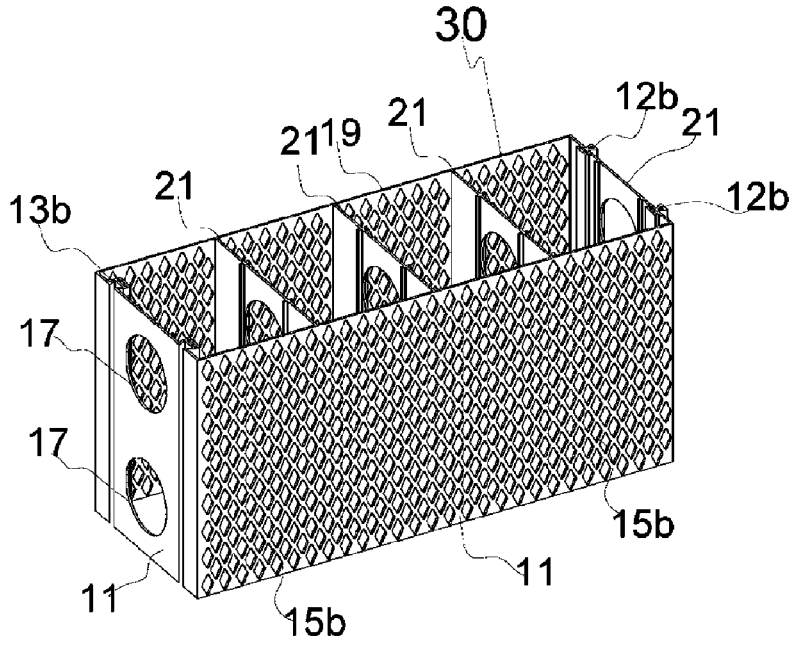
Figure 9G:
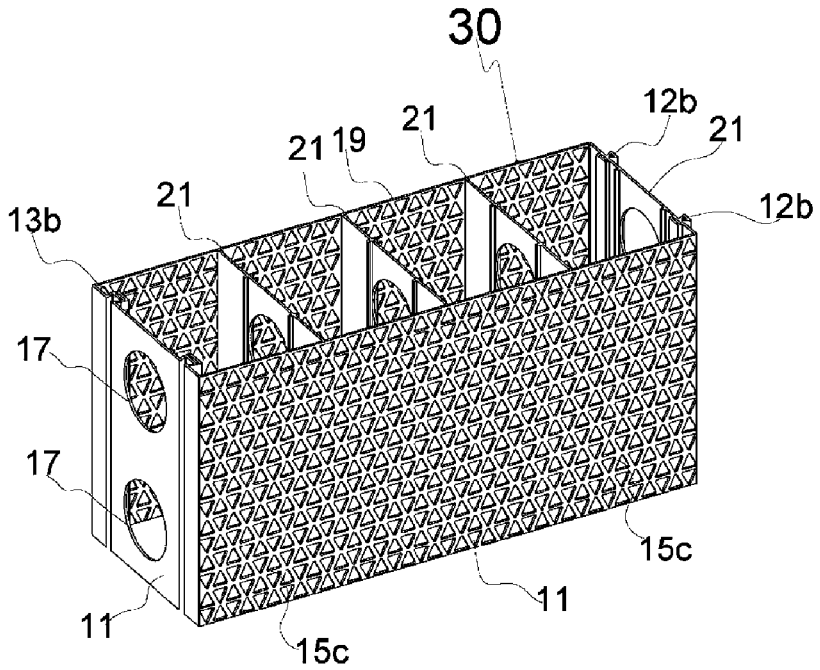
Figure 9H:
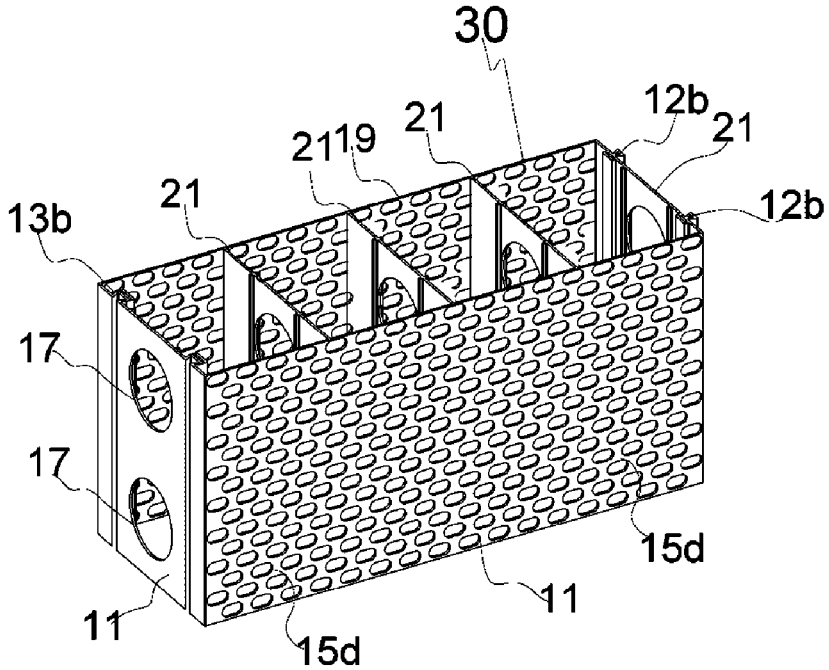
Figure 10A:
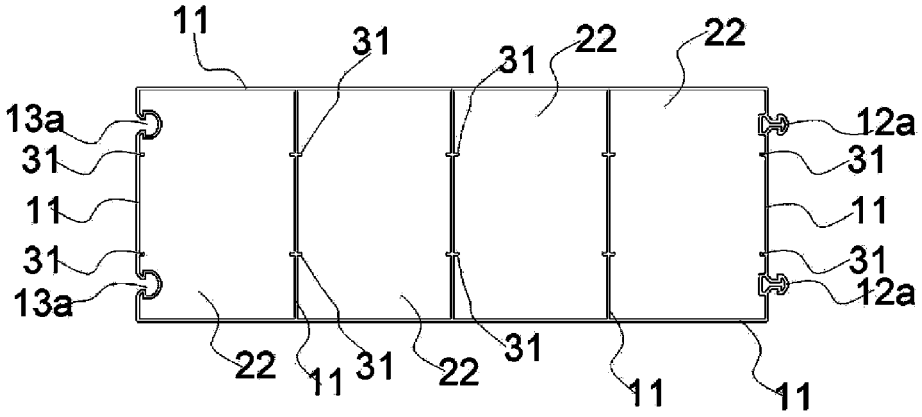
FIGS. 10A and 10B show schematically the top view of the modular multi-perforated panel of FIG. 9A with details of different female and male couplings.
Figure 10B:
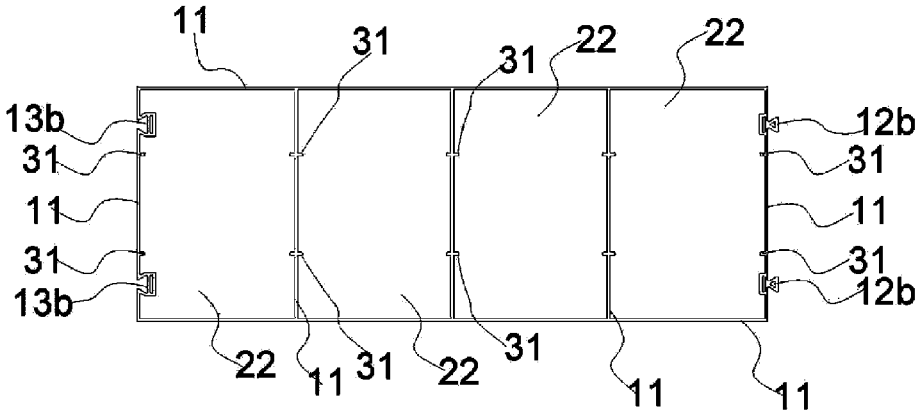

As shown in FIGS. 5 and 6, a flat modular connector profile 20 is characterized by including an elongated longitudinal surface 16 with sections of cores cut 17 longitudinally distributed strategically, parallel longitudinal lips 31 crossing the surface 16, and at both ends of the edge coupling means, with longitudinal U-shaped rail with edges 18 extended inwards.

Referring to Figure sets 7 and 8, a multiperforated flat modular connector 50 with a rectangular configuration is characterized by including a front wall 11, a rear wall 11, each wall multiperforated 15 with multiperforations that can both be of different types 15*a*, 15*b*, 15*c*, 15*d* distributed on the surface 11, longitudinal ribs (or walls) 21 with core sections cut 17 distributed longitudinally, the walls 11 and ribs 21 forming a hollow cavity 22, said multiperforated flat modular connector 50 in a rib 21 having integrated thereon two rails geometrically defined as a female element 13 which may be of the type 13*a* or 13*b*, the remaining rib having two rails integrated geometrically defined as a male element 12 which may be of the type 12*a* or 12*b*, as means of engaging, coupling, and interlocking.

Referring to Figure sets 9 and 10, a multiperforated modular panel 30 is characterized by including a rectangular configuration a front wall 19 with longitudinal multiperforations 15, a rear wall 19 with longitudinal multiperforations 15, which may be of the type 15*a*, 15*b*, 15*c*, 15*d* distributed strategically, a plurality of longitudinal ribs (or extruded walls) 21 with core sections cut 17 longitudinally distributed strategically, these also have parallel longitudinal lips 31 crossing the surface 21, in the configuration of walls 19 and ribs 21 are formed rectangular hollow cavities 22 connected to one another, said modular panel 30 in a rib 21 having two rails integrated geometrically defined as female element 13 which may be of the type 13*a* or 13*b*, the remaining two rails integrated in the other rib 21 having geometrically defined thereon a male element 12 which may be of the type 12*a* or 12*b*, as means of engaging, coupling, and interlocking.

Figure 11:
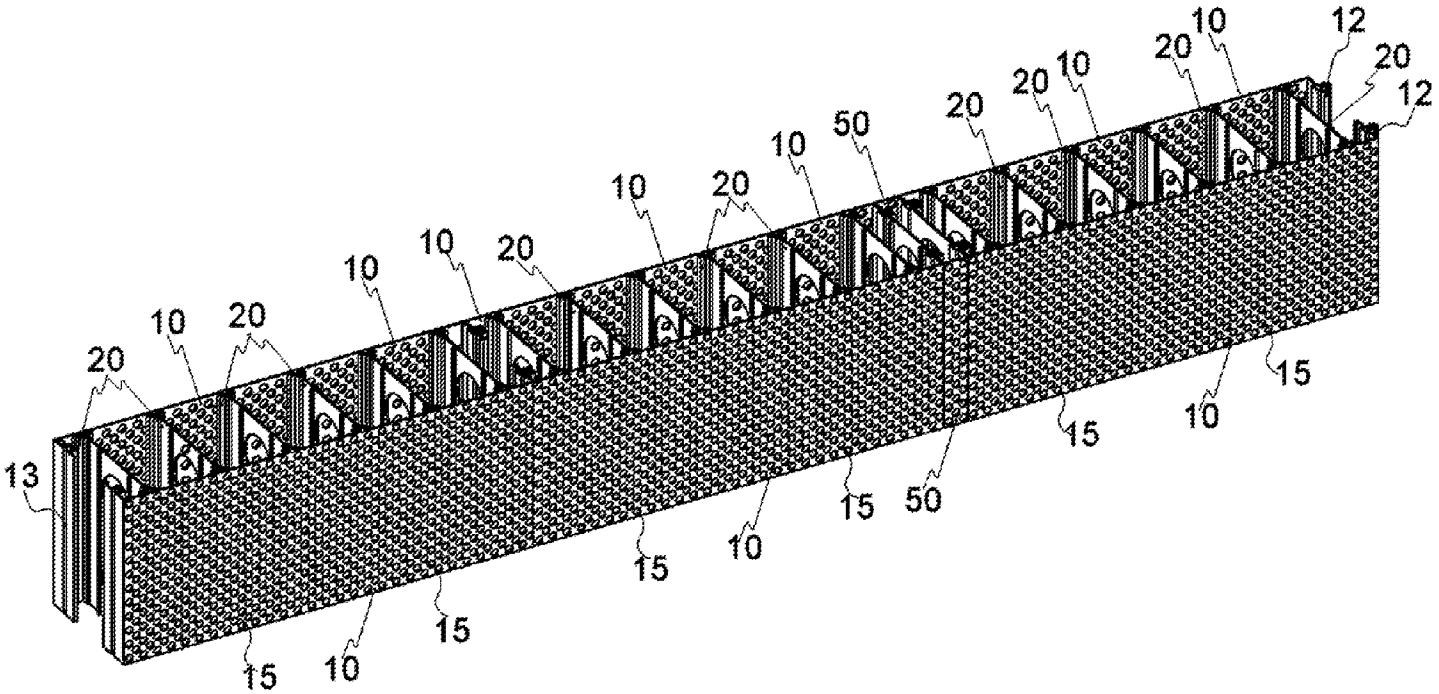
FIG. 11 shows the perspective view of a portion of assembly section of the mold structure multi-perforated permanent formwork, including components of flat profile and flat connecting components with partially enlarged details of the female and male coupling means, also showing the assembly of male-female coupling means, wherein the male type element is engaged, slid and locked against the female type element.

Referring to FIG. 11, a section of assembly consists of six multiperforated modular profiles plates 10, eighteen connector pads 20 and a multiperforated flat modular connector 50, which when assembled as shown subsequently will form a mold structure of permanent formwork with cavities 22 interconnected with multiperforated surfaces 15, cut type cores 17 and assembly of the male elements 12 and female elements 13.

Figure 12:
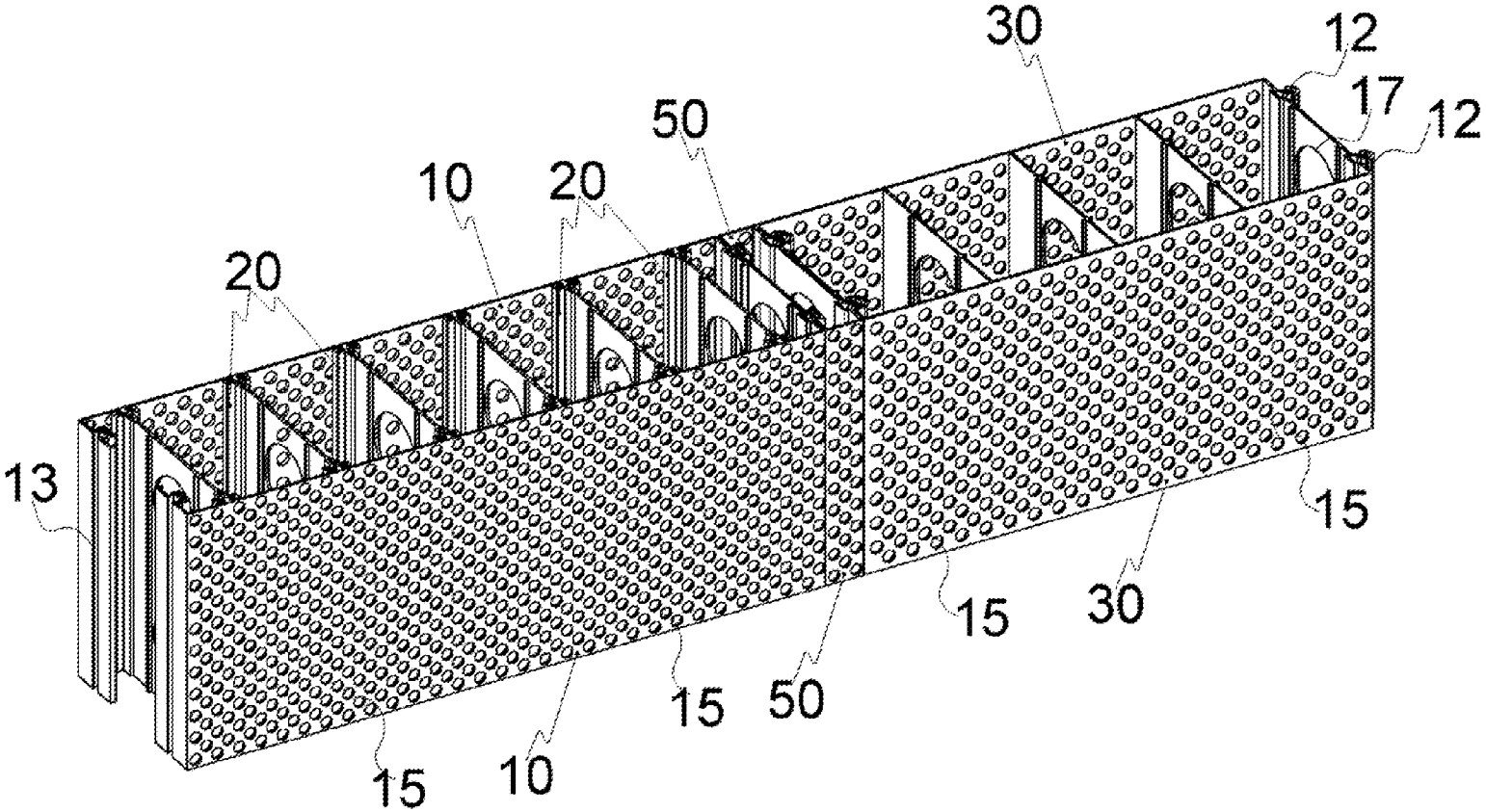
FIG. 12 shows the perspective view of a section of the assembly of permanent formwork mold including flat components, flat connectors and components, and panel-shaped components, with details of the female and male coupling means, also showing the assembly of male-female coupling means, wherein the male type element is engaged, slid and locked against the female type element.

Referring to FIG. 12, a section formed by modular assembly includes multiperforated profile plates 10, flat connectors 20, multiperforated flat modular connectors profiles 50, panel-shaped components 30 which are subsequently to be assembled to form a mold structure permanent formwork with hollow rectangular cavities 22 interconnected with multiperforated surfaces 15, 17 cut type cores and assembly of the male elements 13 and female elements 12.

Figure 13:
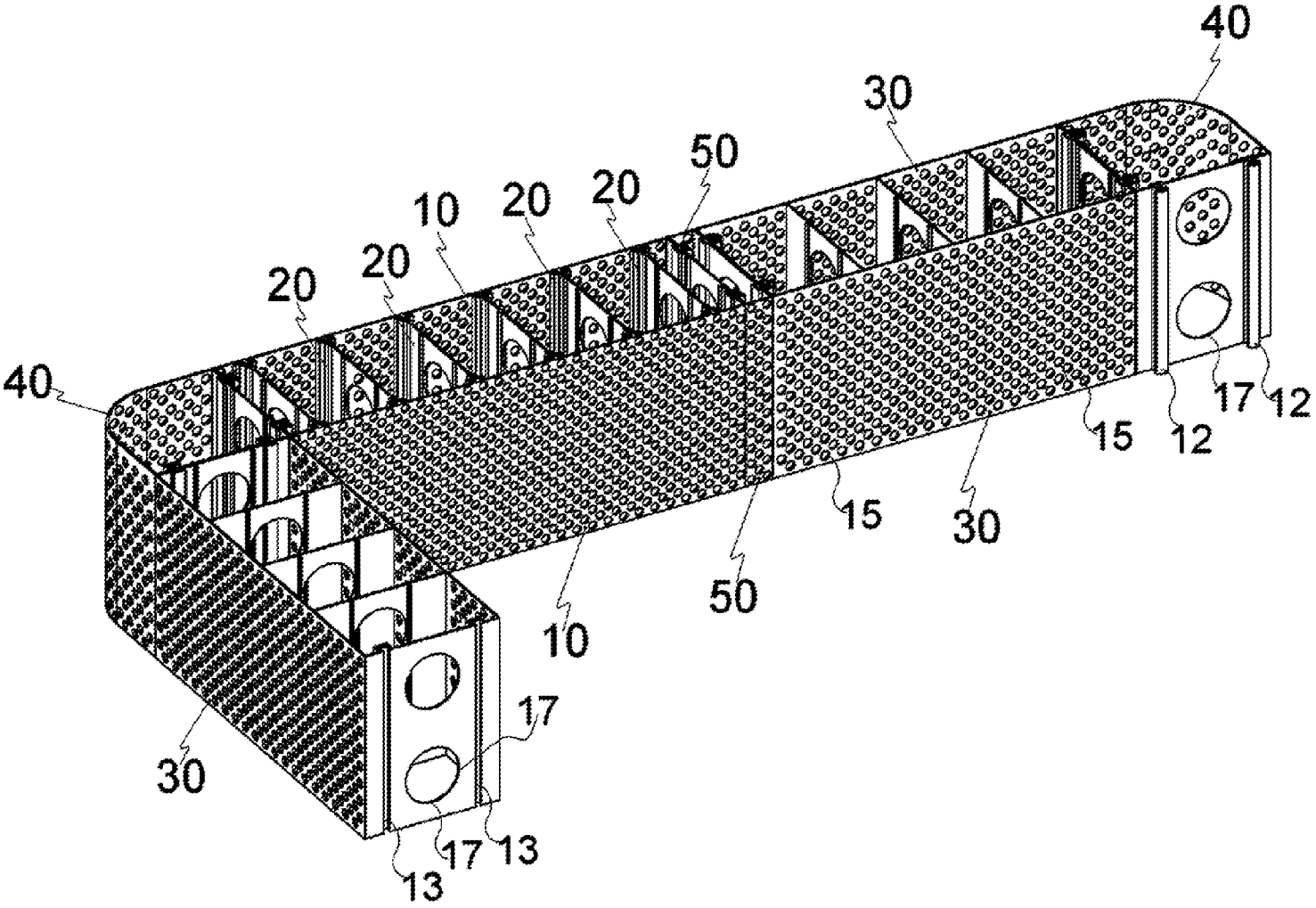
FIG. 13 is a perspective view of an assembly section of the mold structure of permanent formwork mold and includes flat components, flat connectors, panel shaped components and corner shaped components, with details of male-female type assembly coupling means, wherein the male type element is engaged, slid and locked against the female type element.
Figure 14:
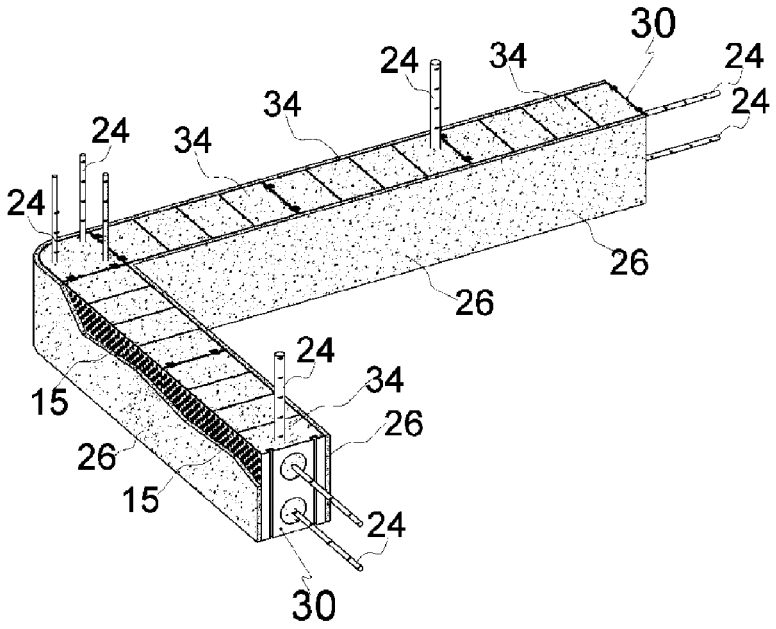
FIG. 14 shows the perspective view of a section of the modular construction system assembly of permanent mold structure formwork for reinforced concrete, including flat structural components, flat connector components, corners components, panel-shaped components, elements of vertical and horizontal structural reinforcements, wherein concrete is shown having been poured into the hollow cavities, thereby showing the behavior of the permanent concrete hiding the permanent multiperforated formwork in the front and back surfaces of the permanent formwork.
Figure 15:
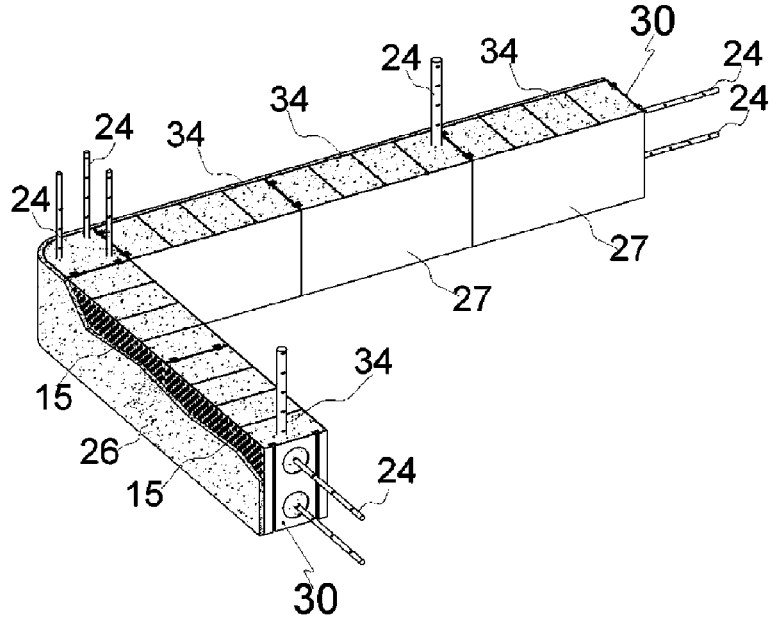
FIG. 15 schematically shows the perspective view of a portion of an assembly section of the modular structure of a permanent multiperforated mold for reinforced concrete formwork modular construction system, including: flat structural components, flat connector components corner connector components, panel shaped components, commercial standards structural elements and reinforcements placed vertically and horizontally, poured concrete in the hollow cavities, showing in particular the behavior of the concrete in the rear face that was multiperforated, hides the permanent formwork while the shown multiperforated front face of the permanent formwork is smooth with plastic finish.
Figure 16:
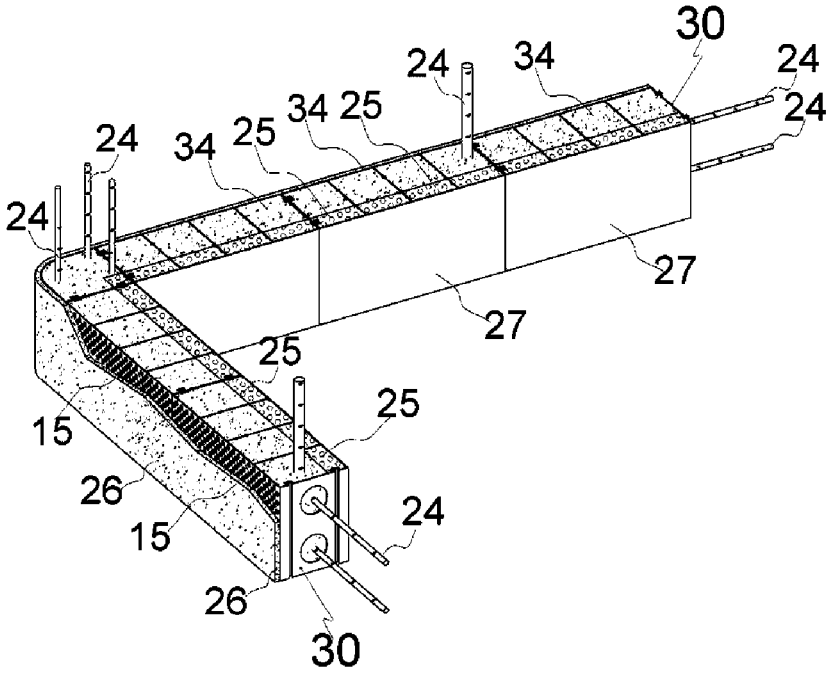
FIG. 16 shows the perspective view of a section of assembly of a mold structure permanent formwork of the multiperforated modular construction system of permanent formwork for reinforced concrete, including flat structural components, flat connector components, corner shaped connecting components, panel-shaped components, vertical and horizontal elements of structural reinforcements, thermoacoustic insulation cores, poured concrete in the hollow cavities, showing in particular the behavior of concrete in the faces with multiperforation.
Figure 17:
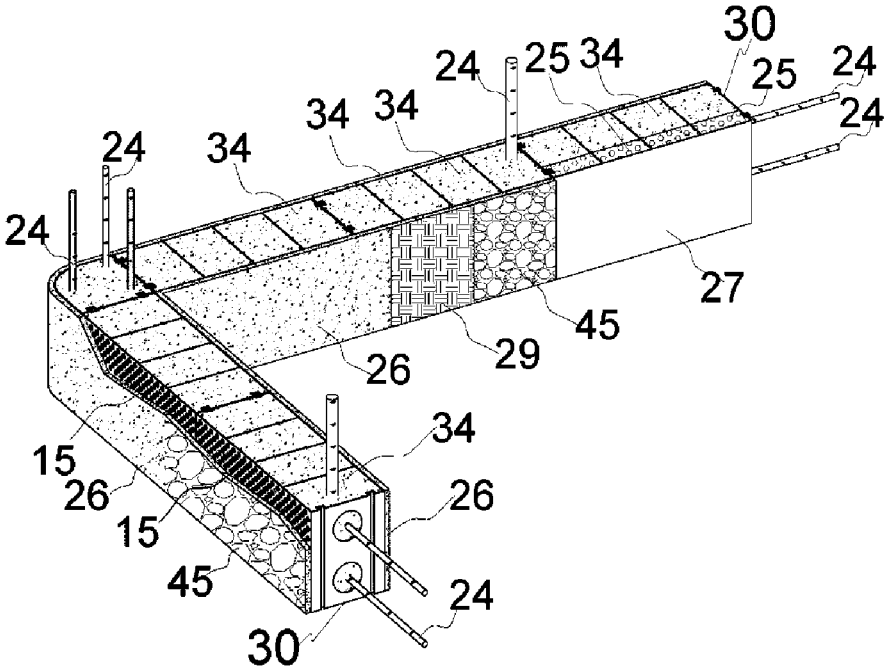
FIG. 17 shows the perspective view of a portion of assembly mold structure permanent formwork of the multiperforated modular construction system permanent formwork for reinforced concrete including flat structural components, flat connector components, corner connectors components, panel shaped components, vertical and horizontal and structural elements and reinforcements, thermoacoustic insulation cores, poured concrete in the hollow cavities, the new texture generated on the surface and some of the different types of additional finishing that can receive the new texture.

Referring to FIG. 13, a section of an assembly is formed by multiperforated flat modular profiles 10, multiperforated corner modular connector profiles 40, flat connectors 20, multiperforated flat modular connectors profiles 50, panel-shaped components 30 which when assembled will subsequently form a mold structure with permanent formwork hollow having rectangular cavities 22 interconnected with multiperforated surfaces 15, having cut type cores 17 and assembly of the male elements 13 and female 12 elements.

Referring to FIGS. 14, 15, 16 and 17 a section of the assembly multiperforated mold structure permanent formwork for reinforced concrete is formed by the multi-perforated plates 10, flat profiles connectors 20, multiperforated modular panels 30, modular connector profiles, multiperforated corner modular connector profiles 40 and 50 multiperforated modular connectors planes, which when assembled subsequently one after another, these system components give form to a mold structure permanent formwork for reinforced concrete with hollow cavities 22 interconnected to each other, where front and back faces of this structure may be multiperforated 15, this mold structure permanent formwork generated in the assembly being reinforced with structural elements 24 that can be vertically and horizontally situated, in addition with the alternative of adding cores of thermo acoustic insulation 25 in the hollow cavities 22, then spreads concrete 34 in these mold cavities of the permanent formwork, wherein the concrete surfaces multiperforations 15 spread the concrete 34 "will come out and generate" a new texture to the surface 26, covering and hiding the permanent mold structure formwork, this structure in its front and rear surfaces, depending on the construction project, can be on one side of the form 26 and the remaining side of the finish surface can be smooth plastic surfaces 27. Specifically generated surfaces 26 enable the making of any type of finish as in smooth flattened type 26, or textured surface 29; or enable attaching other material 45 shown as additional finishing.

This invention has been described in detail with reference to specific embodiments thereof, including the best mode for carrying out embodiments. The illustrations are by way of example only and not a limitation. What is considered as a novelty, and therefore claimed as property, is contained in the appended claims.

The invention claimed is:

1. A modular permanent formwork system for use with a pourable construction material, comprising:

a plurality of extruded elements, with at least some of the extruded elements being of different configuration, and wherein at least some of the extruded elements comprise an extrudate that defines an internal pourable construction material reception cavity, and each extruded element includes the following:

a) at least a first perforated wall that has a perforation set communicating with said reception cavity such that the pourable construction material is able to pass from the reception cavity and through the perforation set to an outer surface of the first perforated wall, b) one or more core cavity walls, with each core cavity wall having a through-hole for fluid communication of the pourable construction material;

c) an extruded male and female coupling member each formed in an exterior surface of the extruded element, and wherein the male coupling member or female coupling member of one of the plurality of extruded elements is coupled with a coupling member of another of said plurality of extruded elements, and wherein the plurality of extruded elements include extrudates that have a rectangular peripheral configuration at a time of initial formation, and said rectangular peripheral configuration is maintained in the permanent formwork system and includes a hollow that provides at least one of the internal pourable construction material reception cavities.

2. The modular system of claim 1 wherein the perforation set is arranged essentially over the entire surface of the first perforated wall such that, upon passage of the pourable construction material to the outer surface of the first perforated wall, there is sufficient passed pourable construction material to enable spreading and covering over essentially the entire outer surface of the first perforated wall with the spread construction material.

3. A method of forming the modular system of claim 1 comprising coupling together members of the extruded elements so as to form a modular framework and pouring the pourable construction material so that the construction material flows from the reception cavities of coupled extruded elements both externally through the perforation set or sets of the associated element and internally between coupled elements sharing communication through-holes.

4. The modular system of claim 1, wherein each extrudate has a floor-to-ceiling longitudinal length L, and the male and female coupling members extend continuously for the full length L and not more than length L.

5. The formwork system of claim 1, wherein the plurality of extrudates include a corner configuration comprising two planar walls and a curved perforated wall which form an enclosed, hollow peripheral corner configuration at a time of initial formation, and which enclosed, hollow peripheral corner configuration is maintained in the permanent formwork system.

6. A modular permanent formwork system suitable for use with concrete, comprising:

a plurality of extrudate components with at least some of the extrudate components being of different configuration, and wherein at least some of the extrudate components define a plurality of interconnected cavities, the plurality of extrudate components including an extrudate component that is a flat multiperforated profile and comprises:

i. a longitudinal surface having a plurality of perforations; and ii. at each opposite end of the longitudinal surface there is provided an edge that is perpendicular to the longitudinal surface, and along each opposite edge respective female and male interlocking elements are provided; and;

iii. a plurality of longitudinal rails of a first shape to receive at least one flat connector, the plurality of longitudinal rails disposed at intervals along the width of the longitudinal surface;

wherein the plurality of perforations provided in the longitudinal surface are dimensioned for communication with at least one of the interconnected cavities such that if concrete were poured into the resulting permanent formwork it would be able to pass from the at least one of said interconnected cavities and through at least one of the plurality of perforations to an outer surface of the resulting permanent formwork as to form a concrete covering on that outer surface.

7. The system according to claim 6, wherein the plurality of extrudate components further comprises at least one modular multiperforated hollow corner connector including:

i. two perpendicular longitudinal elongated faces joined together with cut cores distributed longitudinally;

ii. a multiperforated semicircular longitudinal surface having a plurality of perforations, the surface attached to the two perpendicular longitudinal elongated surfaces; and iii. at the perpendicular longitudinal faces, respective female and male interlocking elements suitable for connecting to at least one other component of the plurality of components.

8. The system according to claim 6, wherein the plurality of extrudate components further comprises at least one flat modular connector having:

i. first and second longitudinal surfaces each with sections of cut cores strategically distributed longitudinally;

ii. at both ends of the first and second longitudinal surfaces there is provided a longitudinal rail with extended inward edges having a second shape that is configured for coupling;

iii. front and rear multiperforated walls;

iv. the first and second longitudinal surfaces being distributed perpendicular to the front and rear multiperforated walls; and v. wherein the longitudinal rails in the first and second longitudinal surfaces define, respectively, female and male elements suitable for coupling to at least one other component of the plurality of extrudate components.

9. The system according to claim 6, wherein the plurality of extrudate components further comprises at least one of a multiperforated modular panel of rectangular configuration including:

i. a longitudinal front and rear wall with at least one of the front and rear walls being multiperforated;

ii. a plurality of longitudinal ribs with core cut sections strategically distributed longitudinally, and the ribs extending between the front and rear walls as to form interconnected rectangular cavities; and iii. at each end of the multiperforated modular panel there is provided integrated respective female and male elements suitable for connecting to at least one other component of the plurality of extrudate components.

10. The system according to claim 6, wherein the first shape is selected from a U-shape and a T-shape.

11. The system according to claim 8, wherein the second shape is selected from a U-shape and a T-shape.

12. The system according to claim 6, wherein the plurality of extrudate components include both a full longitudinal length extruded female interlocking element and a full longitudinal length extruded male interlocking element as to provide for longitudinal slide coupling at two different locations of each extrudate component.

13. The system according to claim 6, wherein at least one of the plurality of extrudate components is made of a thermoplastic material.

14. A process of forming a permanent formwork using the modular system according to claim 6, wherein the assembly of the permanent formwork includes the steps of:

a. continuously and subsequently coupling the extrudate components of the modular system, whereby each extrudate component's male interlocking element is coupled with the female interlocking element of another extrudate component such that it is engaged, is fitted and respectively slides into a locking state;

b. assembling of the extrudate components of the system to form a structural configuration with permanent formwork molds multi-perforated with all interior hollow cavities communicating with each other, and wherein at least one of the front and back walls of the permanent formwork mold are multiperforated; and c. pouring concrete into the permanent formwork mold such that the concrete flows to at least one of the interior hollow cavities and at least one of the exposed surfaces of the permanent formwork mold via the multiperforations in at least one extrudate component.

15. The process according to claim 14, further comprising the step of allowing the poured concrete to sprout through the multiperforations to hide the permanent formwork obtaining a new surface.

16. The process according to claim 15, further comprising the step of applying a finish to the new surface, the finish selected from one of smooth, textured and adding other material.

17. The process according to claim 15, further comprising the step of placing at least one of electrical, voice, data wiring, water, sanitary facilities, vertical elements, horizontal elements, structural reinforcements, and thermoacoustic insulation cores, doors, and windows within the permanent formwork.

18. The system of claim 6, wherein the plurality of perforations are provided in each component.

19. A modular, multiperforated permanent formwork or centering construction system for reinforced concrete, comprising:

a front wall and a rear wall having a plurality of perforations through which the concrete springs as to provide a new surface to which a surface finish can be provided;

various extruded thermoplastic structural extrudate profiles, with each profile being a single longitudinal member going from the floor to the ceiling; and the various extrudate profiles comprising an elongated hollow rectangular configuration, reinforcement ribs for the rectangular shape and core sections transversally cut in the ribs in order to introduce reinforcing rods into the structure and to evenly allow the progressive filling of concrete from profile to profile, and where lateral faces of the profile comprise male-female longitudinal coupling rails;

said extrudate profiles comprising:

a flat extrudate profile comprising a multiperforated longitudinal surface; at each end of the multiperforated longitudinal surface there is provided a perpendicular longitudinal extension, with each extension comprising one of a male configured coupling rail and a female configured coupling rail; and along the width of the multiperforated longitudinal surface there is a plurality of longitudinal T-shaped rails for engaging a connector profile;

a flat modular connector profile comprising a longitudinal surface with cut core sections distributed longitudinally, and at opposite ends of the longitudinal surface there is a U-shaped longitudinal rail with inwardly extending edges;

a longitudinal hollow rectangular section flat modular connector profile comprising a multiperforated front wall, a multiperforated rear wall and longitudinal ribs with cut core sections, which longitudinal ribs are perpendicularly attached to the multiperforated walls for forming the rectangular shape, and male and female configured coupling rails are provided at the edges or ends of the rectangular shape;

a corner hollow modular connector profile comprising two interconnected elongated perpendicular longitudinal sides, with cut cores longitudinally distributed on each side, the longitudinal sides are attached to a semicircular longitudinal multiperforated surface, a perpendicular longitudinal side has two integrated female-configuration coupling rails, the remaining side has two male-configuration coupling rails;

a modular elongated hollow rectangular configuration panel, comprising: a longitudinal multiperforated front wall, a longitudinal multiperforated rear wall, a plurality of longitudinal ribs with core cut sections distributed longitudinally, forming between these, interconnected hollow rectangular cavities, at the ends of the multiperforated modular panel on the coupling edges there are two female-configuration longitudinal coupling rails, and the remaining end having two integrated male-configuration longitudinal coupling rails;

and wherein the male and female coupling rails on said respective structural extrudate profiles provide a coupling means that comprises a shape and geometry defined as a female locking member and a male locking member, the male locking member fits and slides on a groove of the female locking member in the coupling such that different ones of the various extruded profiles can be coupled to another type of extruded profile.

20. A modular, multiperforated permanent formwork or centering construction system for reinforced concrete according to claim 19, when longitudinally, adjacently and subsequently assembled from the floor to the ceiling by its male-female coupling means, which together achieve a permanent formwork or mold structure with a front and rear side, at least one of front and rear sides being multiperforated; with multiperforations that are dimensioned such that poured concrete will spring through the multiperforations and hide the permanent formwork obtaining a new surface, and any type of finish can be made either smooth, textured or adding other material.

21. A modular, multiperforated permanent formwork or centering construction system for reinforced concrete according to claim 20, wherein one surface is a multiperforated surface and the other one is a smooth surface without multiperforation.

22. A method for producing a modular, multiperforated permanent formwork or centering construction for reinforced concrete, which formwork includes various extruded thermoplastic extrudates with a defined configuration, structural reinforcement rods, and poured concrete, the method comprising:

a. assembling the different types of longitudinal thermoplastic extrudates, having coupling male projection rails and female groove rails, in a foundation with vertical reinforcing rods extending within at least some of the extrudates;

b. fitting and sliding the male rail of one extrudate on the groove of the female rail of another extrudate;

c. transversely crossing reinforcing rods into cut section areas of aligned extrudates;

d. forming, by assembling said elements, a wall structure with sectioned hollow cavities;

e. pouring and filling the hollow cavities with concrete, in the wall structure;

f. flattening or texturing concrete present on at least one of a front wall surface and a rear wall surface of the associated extrudates, wherein, upon pouring, the concrete sprouts through perforations, and extends along an outer region of at least one of the front and rear wall surfaces.

23. The method of claim 22, wherein outer regions of both the front and rear wall surfaces have concrete that is either flattened or textured.

24. The method of claim 22, wherein the perforations are formed in the front wall and the rear wall contacts an insulation core.

* * * * *